US011206905B2

(12) United States Patent
Ma

(10) Patent No.: US 11,206,905 B2
(45) **Date of Patent: *Dec. 28, 2021**

(54) UMBRELLA HUB ASSEMBLY

(71) Applicant: Zhun-An Ma, Ningbo (CN)

(72) Inventor: Zhun-An Ma, Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/989,033

(22) Filed: Aug. 10, 2020

(65) Prior Publication Data

US 2021/0030127 A1 Feb. 4, 2021

Related U.S. Application Data

(63) Continuation of application No. 15/833,319, filed on Dec. 6, 2017, now Pat. No. 10,736,390.

(60) Provisional application No. 62/431,114, filed on Dec. 7, 2016.

(51) Int. Cl.

| | |
|---|---|
| ***A45B 25/06*** | (2006.01) |
| ***A45B 25/02*** | (2006.01) |
| ***A45B 25/10*** | (2006.01) |
| *A45B 17/00* | (2006.01) |

(52) U.S. Cl.

CPC ..... *A45B 25/06* (2013.01); *A45B 25/02* (2013.01); *A45B 25/10* (2013.01); *A45B 17/00* (2013.01)

(58) Field of Classification Search

CPC ..... A45B 25/02; A45B 25/06; A45B 25/10

See application file for complete search history.

(56) References Cited

U.S. PATENT DOCUMENTS

| | | | |
|---|---|---|---|
| 331,231 | A | 11/1885 | Folger |
| 476,364 | A | 6/1892 | Collins |
| 501,089 | A | 7/1893 | Lichtenstein |
| 620,815 | A | 3/1899 | Warren |
| 750,178 | A | 1/1904 | Fesenfeld |
| 770,704 | A | 9/1904 | Vogel |
| 847,805 | A | 3/1907 | McAvoy |
| 878,270 | A | 2/1908 | Blake et al. |
| 880,534 | A | 3/1908 | Hoyt |

(Continued)

FOREIGN PATENT DOCUMENTS

| | | |
|---|---|---|
| CA | 1269018 | 5/1990 |
| CN | 2722687 | 9/2005 |

(Continued)

OTHER PUBLICATIONS

EPO Extended Search Report dated Apr. 5, 2011 for European Patent No. 09252140.0, filed Sep. 7, 2009.

(Continued)

*Primary Examiner* — David R Dunn
*Assistant Examiner* — Danielle Jackson
(74) *Attorney, Agent, or Firm* — Knobbe, Martens, Olson & Bear, LLP

(57) ABSTRACT

An umbrella assembly can be assembled using L-shaped elongate members pivotably coupled with upper and lower hubs for supporting and actuating an umbrella cover. The L-shaped elongate members can be pivotably coupled together and paired such that a lateral portion of each of the elongate members extends opposite the other lateral portion within the pair and pivotably coupled with one of the upper hub and the lower hub. The lateral portions pivotably coupled within rib-receiving slots corresponding to one of the upper hub and the lower hub and secured within the rib-receiving slots by one of an upper hub cap and a lower hub cap.

19 Claims, 22 Drawing Sheets

(56) References Cited

U.S. PATENT DOCUMENTS

| | | | |
|---|---|---|---|
| 897,026 | A | 8/1908 | Seitzinger |
| 899,718 | A | 9/1908 | Eberle |
| 924,627 | A | 6/1909 | Baker et al. |
| 928,169 | A | 7/1909 | Bardon |
| 941,952 | A | 11/1909 | Riehl |
| 947,790 | A | 2/1910 | Carter |
| 959,127 | A | 5/1910 | Edwards |
| 1,001,076 | A | 8/1911 | Redford |
| 1,022,944 | A | 4/1912 | Hodinger |
| 1,078,069 | A | 11/1913 | Simons |
| 1,107,415 | A | 8/1914 | Drohan |
| 1,184,764 | A | 5/1916 | Marsh |
| 1,228,810 | A | 6/1917 | Neu, Sr. |
| 1,264,075 | A | 4/1918 | Hout |
| 1,469,495 | A | 10/1923 | Bunker |
| 1,712,430 | A | 5/1929 | Giszczynski |
| 1,808,610 | A | 6/1931 | Roy |
| 1,852,513 | A | 4/1932 | Frey |
| 1,862,674 | A | 6/1932 | Frey |
| 2,101,510 | A | 12/1937 | Rathbun |
| 2,207,043 | A | 7/1940 | Weiss et al. |
| 2,321,495 | A | 6/1943 | Levin |
| 2,336,116 | A | 12/1943 | Morando |
| 2,385,575 | A | 9/1945 | Isler |
| 2,469,637 | A | 5/1949 | Evans et al. |
| 2,635,616 | A | 4/1953 | Haydu |
| 2,762,383 | A | 9/1956 | Wittman |
| 2,796,073 | A | 6/1957 | Wittman |
| 2,860,647 | A | 11/1958 | Negri |
| 2,914,154 | A | 11/1959 | Russell |
| 3,157,186 | A | 11/1964 | Hammer |
| 3,177,882 | A | 4/1965 | Vincent |
| 3,181,542 | A | 5/1965 | Bareis |
| 3,252,468 | A | 5/1966 | Militano |
| 3,330,582 | A | 7/1967 | Morris |
| 3,424,180 | A | 1/1969 | Andolfi |
| 3,462,179 | A | 8/1969 | Hinkle |
| 3,557,809 | A | 1/1971 | Vazquez et al. |
| 3,643,673 | A | 2/1972 | Weber |
| 3,704,479 | A | 12/1972 | Whitaker |
| D231,955 | S | 6/1974 | Weber |
| 4,201,237 | A | 5/1980 | Watts et al. |
| 4,368,749 | A | 1/1983 | Lindler et al. |
| 4,369,000 | A | 1/1983 | Egnew |
| 4,627,210 | A | 12/1986 | Beaulieu |
| 4,673,308 | A | 6/1987 | Reilly |
| 4,750,509 | A | 6/1988 | Kim |
| 4,790,338 | A | 12/1988 | Strobl |
| 4,941,499 | A | 7/1990 | Pelsue et al. |
| 4,966,178 | A | 10/1990 | Eichhorn |
| D320,111 | S | 9/1991 | Ma |
| 5,056,291 | A | 10/1991 | Leung |
| D321,779 | S | 11/1991 | Ma |
| 5,069,572 | A | 12/1991 | Niksic |
| 5,085,239 | A | 2/1992 | Chin-Hung et al. |
| 5,188,137 | A | 2/1993 | Simonelli |
| 5,193,566 | A | 3/1993 | Chen |
| 5,328,286 | A | 7/1994 | Lee |
| D360,522 | S | 7/1995 | Ko |
| 5,433,233 | A | 7/1995 | Shiran et al. |
| 5,445,471 | A | 8/1995 | Wexler et al. |
| 5,694,958 | A | 12/1997 | Chang |
| 5,715,853 | A | 2/1998 | Lin |
| 5,738,129 | A | 4/1998 | Vogt |
| 5,740,824 | A | 4/1998 | Tang |
| 5,746,235 | A | 5/1998 | Lin |
| 5,797,613 | A | 8/1998 | Busby |
| 5,797,695 | A | 8/1998 | Prusmack |
| 5,842,494 | A | 12/1998 | Wu |
| D411,655 | S | 6/1999 | Tung |
| 5,911,233 | A | 6/1999 | Wu |
| D412,056 | S | 7/1999 | Wang |
| 6,076,540 | A | 6/2000 | You |
| 6,095,169 | A | 8/2000 | Lin et al. |
| 6,116,256 | A | 9/2000 | Pawsey et al. |
| 6,199,572 | B1 | 3/2001 | Rousselle et al. |
| 6,227,753 | B1 | 5/2001 | Boer |
| 6,298,867 | B1 | 10/2001 | Chang |
| 6,311,706 | B1 | 11/2001 | Sato |
| 6,314,976 | B1 | 11/2001 | Clarke |
| 6,332,657 | B1 | 12/2001 | Fischer |
| 6,345,637 | B1 | 2/2002 | Ko |
| 6,354,316 | B1 | 3/2002 | Chen |
| 6,374,840 | B1 | 4/2002 | Ma |
| 6,386,215 | B1 | 5/2002 | Chang |
| 6,397,867 | B2 | 6/2002 | You |
| D460,947 | S | 7/2002 | Montena |
| 6,446,650 | B1 | 9/2002 | Ma |
| D465,915 | S | 11/2002 | Earnshaw |
| 6,499,856 | B2 | 12/2002 | Lee |
| 6,604,844 | B2 | 8/2003 | Hussey |
| 6,643,889 | B1 | 11/2003 | Kotlarski |
| 6,651,682 | B1 | 11/2003 | Woodward |
| 6,701,946 | B2 | 3/2004 | You |
| 6,705,335 | B2 | 3/2004 | You |
| 6,732,753 | B2 | 5/2004 | Chang |
| 6,758,228 | B1 | 7/2004 | You |
| 6,758,354 | B2 | 7/2004 | Carletti |
| 6,769,441 | B2 | 8/2004 | Liu |
| 6,814,093 | B2 | 11/2004 | You |
| 6,904,923 | B2 | 6/2005 | Chai et al. |
| 7,178,535 | B2 | 2/2007 | Eder |
| 7,412,985 | B2 | 8/2008 | Ma |
| 7,464,503 | B2 | 12/2008 | Hoberman |
| 7,481,235 | B2 | 1/2009 | Prusmack |
| 7,497,583 | B2 | 3/2009 | Ma |
| 7,509,967 | B2 | 3/2009 | Kim |
| 7,574,777 | B1 | 8/2009 | Fuller et al. |
| 7,637,276 | B2 | 12/2009 | Mallookis et al. |
| 7,686,024 | B1 | 3/2010 | Lai |
| 7,703,464 | B2 | 4/2010 | Ma |
| D623,396 | S | 9/2010 | He |
| D626,324 | S | 11/2010 | Ma |
| 7,861,734 | B2 | 1/2011 | Ma |
| D631,848 | S | 2/2011 | Montena et al. |
| 7,891,367 | B2 | 2/2011 | Ma |
| 8,061,375 | B2 | 11/2011 | Ma |
| 8,069,872 | B2 | 12/2011 | Bae |
| 8,082,935 | B2 | 12/2011 | Ma |
| 8,082,937 | B2 | 12/2011 | Tarter et al. |
| 8,166,986 | B2 | 5/2012 | Ma |
| D661,659 | S | 6/2012 | Natoli et al. |
| D662,064 | S | 6/2012 | Natoli et al. |
| D668,446 | S | 10/2012 | Patzak |
| D670,901 | S | 11/2012 | Rothbucher et al. |
| 8,356,613 | B2 | 1/2013 | Ma |
| 8,360,085 | B2 | 1/2013 | Lee |
| 8,485,208 | B2 | 7/2013 | Seo |
| 8,496,019 | B2 | 7/2013 | Zhou |
| 8,522,804 | B1 | 9/2013 | Tung |
| 8,534,304 | B1 | 9/2013 | Tung |
| 8,555,905 | B2 | 10/2013 | Ma |
| 8,763,620 | B1 | 7/2014 | Tung |
| 8,800,577 | B2 | 8/2014 | Ma et al. |
| D719,342 | S | 12/2014 | Ma |
| D719,343 | S | 12/2014 | Ma |
| 8,899,250 | B1 | 12/2014 | Tung |
| 9,060,576 | B2 | 6/2015 | Siegenthaler |
| 9,078,497 | B2 | 7/2015 | Ma |
| 9,113,683 | B2 | 8/2015 | Ma |
| D738,609 | S | 9/2015 | Ma |
| 9,192,215 | B2 | 11/2015 | Ma |
| D744,742 | S | 12/2015 | You |
| D749,835 | S | 2/2016 | Whitaker |
| 9,265,313 | B1 | 2/2016 | Ma |
| D750,364 | S | 3/2016 | Lah |
| 9,433,269 | B2 | 9/2016 | Ma |
| 9,498,030 | B2 | 11/2016 | Ma |
| 9,615,637 | B1 | 4/2017 | Tung |
| D786,661 | S | 5/2017 | Wright |
| 9,642,421 | B2 | 5/2017 | Ma |
| D813,525 | S | 3/2018 | Ma |
| D814,173 | S | 4/2018 | Ma |
| 10,034,524 | B2 | 7/2018 | Ma |

(56) References Cited

U.S. PATENT DOCUMENTS

| | | | |
|---|---|---|---|
| D826,543 | S | 8/2018 | Ma |
| 10,060,152 | B2 | 8/2018 | Ma |
| D833,137 | S | 11/2018 | Ma |
| 10,292,466 | B2 | 5/2019 | Ma |
| 10,631,603 | B2 | 4/2020 | Ma |
| 10,631,604 | B2 | 4/2020 | Ma |
| 10,631,605 | B2 | 4/2020 | Ma |
| 10,736,390 | B2 | 8/2020 | Ma |
| 10,874,182 | B2 | 12/2020 | Ma |
| 2001/0007260 | A1 | 7/2001 | Rousselle et al. |
| 2004/0025915 | A1 | 2/2004 | Wang |
| 2004/0123891 | A1 | 7/2004 | Ma |
| 2004/0255993 | A1 | 12/2004 | Ma |
| 2005/0115599 | A1 | 6/2005 | You |
| 2005/0236023 | A1 | 10/2005 | Vardy et al. |
| 2006/0005867 | A1 | 1/2006 | Chang |
| 2006/0024128 | A1 | 2/2006 | Chiu |
| 2006/0124160 | A1 | 6/2006 | Lee |
| 2007/0113878 | A1 | 5/2007 | Ko |
| 2007/0172310 | A1 | 7/2007 | Yang et al. |
| 2007/0261728 | A1 | 11/2007 | Lin et al. |
| 2009/0071518 | A1 | 3/2009 | Amsel |
| 2009/0126769 | A1 | 5/2009 | Hoogendoorn |
| 2009/0260664 | A1 | 10/2009 | Ma |
| 2010/0288318 | A1 | 11/2010 | Beaulieu |
| 2011/0017249 | A1 | 1/2011 | Ma |
| 2011/0132418 | A1 | 6/2011 | Ma |
| 2011/0209732 | A1 | 9/2011 | Ma |
| 2011/0214705 | A1 | 9/2011 | Ma |
| 2012/0318316 | A1 | 12/2012 | Choi et al. |
| 2013/0008478 | A1 | 1/2013 | Prieto |
| 2013/0206192 | A1 | 8/2013 | Ma et al. |
| 2014/0026931 | A1 | 1/2014 | Lee |
| 2014/0069476 | A1 | 3/2014 | Zimmer et al. |
| 2015/0237977 | A1 | 8/2015 | Ma |
| 2016/0115707 | A1 | 4/2016 | Schneider et al. |
| 2017/0073993 | A1 | 3/2017 | Ma |
| 2017/0112242 | A1 | 4/2017 | Ma |
| 2018/0110303 | A1 | 4/2018 | Ma |
| 2018/0153269 | A1 | 6/2018 | Ma |
| 2019/0045894 | A1 | 2/2019 | Ma |
| 2019/0119946 | A1 | 4/2019 | Ma |
| 2019/0191834 | A1 | 6/2019 | Ma |
| 2019/0373992 | A1 | 12/2019 | Ma |
| 2020/0315306 | A1 | 10/2020 | Ma |

FOREIGN PATENT DOCUMENTS

| | | |
|---|---|---|
| CN | 2776115 | 5/2006 |
| CN | 204444542 | 7/2015 |
| DE | 1152226 | 8/1963 |
| EP | 0202769 | 12/1989 |
| EP | 0897678 | 2/1999 |
| EP | 2 774 504 | 1/2017 |
| FR | 855628 | 5/1940 |
| FR | 002650491 | 2/1991 |
| FR | 2857835 | 1/2005 |
| GB | 2113543 | 8/1983 |
| GB | 2165448 | 11/1987 |
| JP | 61131921 | 8/1986 |
| JP | H08-322621 | 12/1996 |
| JP | 2002-336020 | 11/2002 |
| JP | 3144314 | 7/2008 |
| JP | 2009-045359 | 3/2009 |
| KR | 100851744 | 8/2008 |
| KR | 10-2009-0110808 | 10/2009 |
| KR | 10-2012-0107607 | 10/2012 |
| WO | WO 2005/023042 | 3/2005 |
| WO | WO 2017/048868 | 3/2017 |

OTHER PUBLICATIONS

Extended European Search Report issued in EP Application No. 14157685, dated Jul. 7, 2014, in 8 pages.

Extended European Search Report issued in EP Application No. 14158057, dated Jul. 7, 2014, in 7 pages.

Extended European Search Report issued in EP Application No. 15156587.6, dated Jul. 23, 2015, in 7 pages.

International Search Report and Written Opinion issued in PCT Application No. PCT/US2016/051771, dated Dec. 28, 2016.

Treasure Garden, 2010 Products Catalog, pp. 20 and 60.

UMBRELLA HUB ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 C.F.R. § 1.57.

BACKGROUND OF THE INVENTION

Field of the Invention

This application relates to a portable umbrella assembly and in particular to umbrella hub and rib assemblies using an easily manufactured rib and hub design and methods of assembling the same.

Description of the Related Art

Many different types of umbrella assemblies exist. Generally, an umbrella assembly comprises a central pole, an upper hub and a lower hub. A plurality of elongate ribs and struts are typically pivotably coupled with the upper and lower hubs, respectively. The upper hub is fixed to the central pole and the lower hub is disposed about the central pole and slideably engaged therewith. The plurality of elongate ribs support a canvas or cover that may be deployed and stowed by movement of the lower hub along the central pole.

Generally, the construction of each of the elongate ribs in the umbrella assembly includes an elongate shaft with a transverse pin at one end. The transverse pin extends out both sides of the elongate ribs in an orthogonal configuration relative to a longitudinal axis of the elongate rib. Each transverse pin, therefore, typically has two opposed ends.

Generally, the umbrella hub has a socket or receiving mechanism that is configured to receive each of the two opposed ends of the transverse pin. The transverse pin and the umbrella hub function together to securely couple together the elongate ribs and the umbrella hub. The transverse pin also provides a pivot location on which the elongate shaft can pivot with respect to the umbrella hub. Thus, the transverse pin when coupled with the hub provides a stable means of pivoting the elongate rib with respect to the hub.

Accordingly, a need has arisen for a simpler and/or more economical construction of umbrella hubs and elongate members and related assemblies that is capable of overcoming drawbacks and limitations of the prior art.

SUMMARY

An aspect of at least one embodiment disclosed herein is the realization that an umbrella assembly can be assembled with a configuration that does not comprise a transverse pin having diametrically opposed ends extending from the elongate rib. For example, the elongate rib can be a wire rod having one end bent into an L-shape. Such a simple construction for an elongate rib provides distinct advantages over an elongate rib having a transverse pin. For example, the simple L-shaped elongate rib can be manufactured out of a single material, such as a wire rod, that is bent at one end into the L-shape.

Another aspect of at least one of the embodiments disclosed herein is the realization that an umbrella hub configured to be pivotably coupled with an L-shaped elongate rib can have a simpler construction because it does not have to accommodate both ends of a transverse pin in each elongate rib. This can result in simpler umbrella hub designs using less material and requiring fewer parts. For example, in some embodiments the umbrella hub can have one retention mechanism for each L-shaped rib where a transverse pin style rib would conventionally require two retention mechanisms for each elongate rib. As another example, in some embodiments the umbrella hub can accommodate a plurality of L-shaped elongate ribs that are spaced more compactly than would be possible with a plurality of conventional elongate ribs.

Another aspect of the current disclosure is the realization of the ease of manufacturing an L-shaped elongate rib. Generally, an elongate rib having a transverse pin is constructed having a hole designed to accommodate the transverse pin and the pin must be separately assembled with the elongate rib. This process is labor-intensive and requires separate manufacturing and assembling steps. Additionally, this construction creates unnecessary failure modes because of the increased number of parts and connections between the parts. In particular, the hole through the end of each elongate rib has localized stress locations around the perimeter of the hole and/or the transverse pin can inadvertently slip out of the hole. An L-shaped elongate rib has a simpler construction than an elongate rib having a transverse pin and can be more easily manufactured and assembled. For example, the L-shaped umbrella rib can be constructed out of a single material that is bent at one end into the L shape. In some embodiments, a stiff wire or rod can be bent at one end to form the L-shape. An exemplary material is a steel rod or wire.

Another aspect of at least one embodiment disclosed herein is the realization of how an L-shaped elongate rib can optionally be used in an umbrella assembly. An elongate rib having a transverse pin is generally securely coupled within its receiving slot in an umbrella hub by both opposing ends of the transverse pin. One potential problem with some configurations of an umbrella assembly comprising an L-shaped elongate rib is the L-shaped rib twisting out of its corresponding receiving slot in an umbrella hub when subjected to a force on the elongate rib in certain directions.

Therefore, one aspect disclosed herein in regards to some embodiments is the realization of a solution to this twisting problem. In some embodiments, an intermediate portion of the L-shaped elongate rib is pivotally coupled with an outer end of an L-shaped umbrella strut. The lateral portion of the L-shaped end of the elongate rib can be bent facing a first direction and the lateral portion of the L-shaped end of the umbrella strut can be bent facing a second direction opposite the first direction. When the paired elongate rib and strut are subjected to a force in the first direction that might tend to twist the inner end of the elongate rib out of its receiving slot in the upper hub, the inner end of the L-shaped strut is held securely within its receiving slot in the lower hub. The L-shaped strut can be held securely because the movement of the L-shaped strut is counteracted by the movement of the L-shaped rib. As a result, the paired elongate rib and strut do not twist out of their respective receiving slots. When the paired elongate rib and strut are subjected to a force in the second direction that might tend to twist the inner end of the strut out of its receiving slot in the lower hub, the inner end of the L-shaped elongate rib is held securely within its receiving slot in the upper hub. The L-shaped rib can be held securely because the force on the L-shaped rib is counteracted by the force from the receiving slot of the L-shaped strut. As a result, the L-shaped rib can be held securely and the paired elongate rib and strut do not twist out of their receiving slots, respectively. Thus the twisting problem can be overcome by pairing the L-shaped elongate rib and the L-shaped strut.

Another aspect of at least one embodiment disclosed herein is the realization that an umbrella pole can comprise a tilt assembly for angling the canopy and an upper portion of the umbrella pole with respect to a lower portion of the umbrella pole. This mechanism can comprise an upper cam member and a lower cam member each having a cam surface with a raised portion. In one embodiment the lower cam member is rotatable relative to the upper cam member and the umbrella pole. The upper portion of the umbrella pole can be fixed to an upper end of the upper cam member and a lower end of the upper cam member can be pivotably coupled with an upper end of a cylindrical member. A lower end of the cylindrical member can be fixed to the lower portion of the umbrella pole. The lower cam member can be disposed on the cylindrical member and rotatably engaged therewith. When the lower cam member rotates, the raised portion of the lower cam surface engages the raised surface of the upper cam surface and thereby causing the upper cam member and the upper portion of the umbrella pole to pivot at an angle with respect to the lower portion of the umbrella pole.

Another aspect of at least one embodiment disclosed herein is the realization that the L-shaped elongate ribs and struts can each pivot independently within the rib-receiving slot of its respective upper and lower hub. This independent pivoting can better accommodate the tilting of the umbrella assembly. Radial portions of the L-shaped elongate struts on an obtuse angle side of the umbrella when the upper portion of the umbrella pole is tilted with respect to the lower portion of the umbrella pole are raised within the radial portion of the rib-receiving slot of the lower hub. Radial portions of the L-shaped elongate ribs on an acute angle side of the umbrella when the upper portion of the umbrella pole is tilted with respect to the lower portion of the umbrella pole are lowered within the radial portion of the rib-receiving slot of the lower hub. The radial portions of the L-shaped elongate ribs on the acute angle side of the umbrella when the upper portion of the umbrella pole is tilted with respect to the lower portion of the umbrella pole are raised within the radial portion of the rib-receiving slot of the upper hub. The radial portions of the L-shaped elongate ribs on the obtuse angle side of the umbrella when the upper portion of the umbrella pole is tilted with respect to the lower portion of the umbrella pole are lowered within the radial portion of the rib-receiving slot of the upper hub.

DETAILED DESCRIPTION

Figure 1C:
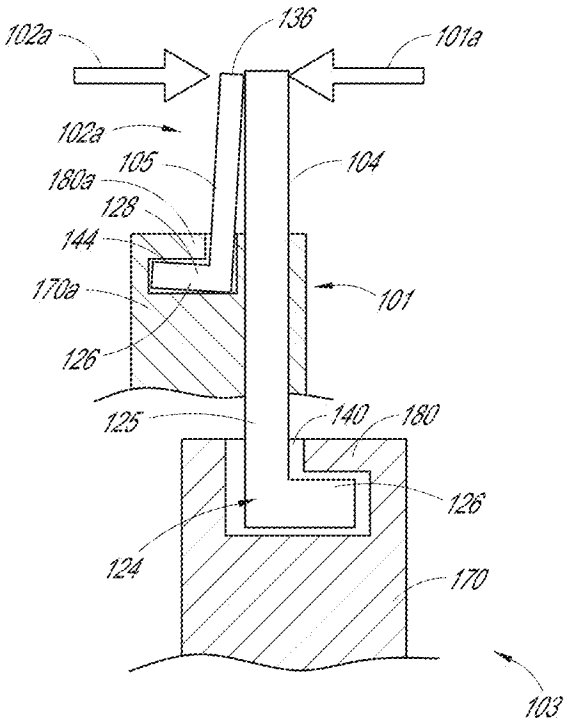
FIG. 1C is a schematic view of the L-shaped elongate rib in the receiving slot of the umbrella hub and an L-shaped strut in a second umbrella hub under the first load and the second load.

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Some embodiments have been described in connection with the accompanying drawings. However, it should be understood that the figures are not drawn to scale. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

For purposes of this disclosure, certain aspects, advantages, and novel features are described herein. It is to be understood that not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Further, the actions of the disclosed processes and methods may be modified in any manner, including by reordering actions and/or inserting additional actions and/or deleting actions. Thus, it is intended that the scope of at least some of the present inventions herein disclosed should not be limited by the particular disclosed embodiments described above. The limitations in the claims are to be interpreted broadly based on the language employed in the claims and not limited to the examples described in the present specification or during the prosecution of the application, which examples are to be construed as non-exclusive.

Figure 1B:
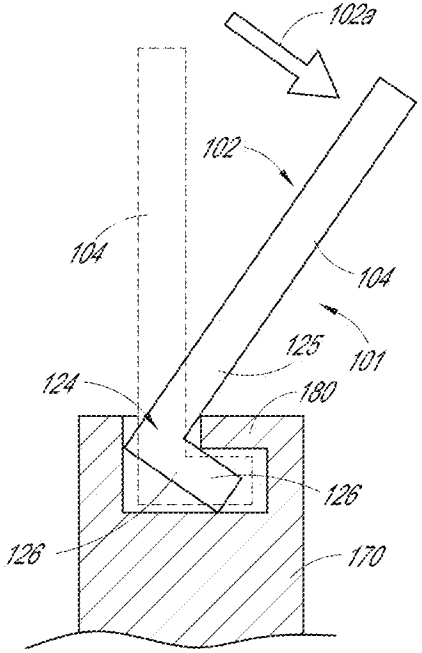
FIG. 1B is a schematic view of the L-shaped elongate rib in the receiving slot of the umbrella hub under a second load.
Figure 1A:
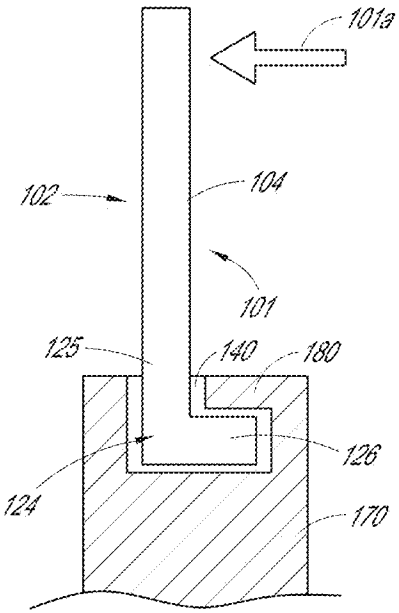
FIG. 1A is a schematic view of an L-shaped elongate rib in a receiving slot of an umbrella hub under a first load.

Referring now to FIGS. 1A-1C, in some embodiments described herein, an L-shaped elongate member 104 is coupled with either of an upper hub or a lower hub in a rib-receiving slot 140. The rib-receiving slot 140 can be within a projection 170 on one of an upper hub or a lower hub of an umbrella assembly. The projection 170 can comprise a blocking structure 180. The L-shaped elongate rib 104 can comprise an inner end 124 and a lateral portion 126 extending in an L-shape from a radial portion 125 of the L-shaped elongate member 104. As illustrated in FIG. 1A, when a first load, illustrated by a first force vector 101*a*, is exerted on the L-shaped elongate member 104 in a first direction, the inner end 124 of the elongate member 104 is not easily removed from within the rib-receiving slot 140. In some embodiments, this can be because of the orientation of the lateral portion 126 within the rib-receiving slot 140 with respect to the first force vector 101*a*. For example, when the first force vector 101*a* is directed towards an interior side 101 of the L-shaped elongate member 104, as in FIG. 1A, the lateral portion 126 will tend to oppose the L-shaped elongate member 104 and prevent it from twisting out of the rib-receiving slot 140 because the lateral portion 126 contacts the blocking structure 180 of the projection 170. As can be seen in FIG. 1A, the interior side 101 can be at a location along the radial portion 125 on the same side as the lateral portion 126. In some embodiments, the blocking structure 180 comprises a blocking member disposed within the projection 170.

Referring now to FIG. 1B, in some embodiments, when a second load, illustrated by a second force vector 102*a*, is exerted on the L-shaped elongate member 104 in a second direction, the inner end 124 of the L-shaped elongate member 104 can be removed from within the rib-receiving slot 140. In some embodiments, this can be because of the orientation of the lateral portion 126 within the rib-receiving slot 140 with respect to the second force vector 102*a*. For example, when the second force vector 102*a* is directed towards an exterior side 102 of the L-shaped elongate member 104, as in FIG. 1B, the lateral portion 126 will not tend to oppose the L-shaped elongate member 104 to prevent it from twisting out of the rib-receiving slot 140. The rib can, in some configurations, thereby be removed from the rib-receiving slot 140. As can be seen in FIG. 1A, the exterior side 102 can be located along the radial portion 125 on an opposite side of the lateral portion 126. The tendency of the L-shaped elongate member 104 to be dislodged from the rib-receiving slot 140 by a force on the exterior side 102 can present a problem in manufacturing a shade structure assembly that can perform robustly under a variety of load conditions produced by users, wind and other environmental factors.

This problem of an L-shaped rib being vulnerable to dislodgement in one direction but not in an opposing direction can be remedied by increasing the tightness of the fit of the L-shaped elongate member 104 within the rib-receiving slot 140. Referring now to FIG. 1C, in some embodiments, as a solution to this problem a second L-shaped elongate member 105 can be coupled with L-shaped elongate member 104 to form an umbrella assembly 103. The umbrella assembly 103 can include the projection 170 with the rib-receiving slot 140 and a second projection 170*a* including a second rib-receiving slot 144 on one of the upper hub or the lower hub. The second L-shaped elongate member 105 can have an inner end 128 with a lateral portion 126*a*, similar to the L-shaped elongate member 104 and facing in a direction opposite the lateral portion 126 of the inner end 124 of the L-shaped elongate member 104. The second L-shaped elongate member 105 can be pivotally coupled with the L-shaped elongate member 104 at a pivotable coupling 136. This pivotable coupling 136 links the second L-shaped elongate member 105 with the L-shaped elongate member 104 such that either of the first load illustrated by the first force vector 101*a* or the second load illustrated by the second force vector 102*a* will be transferred between the second L-shaped elongate member 105 and the L-shaped elongate member 104.

Thus, when either of the first or second force vectors 101*a*, 102*a* are exerted on the assembled L-shaped elongate members 104 and 105, at least one of the lateral portions 126/126*a* of the L-shaped elongate members will tend to oppose either of the L-shaped elongate members 104 or 105 and prevent them from twisting out of the rib-receiving slots 140 or 144, respectively. More specifically, while the load illustrated by the first force vector 101*a* could tend to dislodge the member 105, interaction between the member 104 and the projection 170 as well as the pivotably coupling 136 between the members 104, 105 will prevent the member 105 from moving out of the slot 144. While the load illustrated by the second force vector 102*a* could tend to dislodge the L-shaped elongate member 104, the interaction between the L-shaped elongate member 105 and the second projection 170*a* as well as the pivotable coupling 136 between the L-shaped elongate members 104, 105 will prevent the L-shaped elongate member 104 from moving out of the rib-receiving slot 140. This can be because at least one of the lateral portions 126/126*a* contacts the blocking structure 180/180*a* of the projection 170/170*a* from within the rib-receiving slot 140/144.

Figure 2:
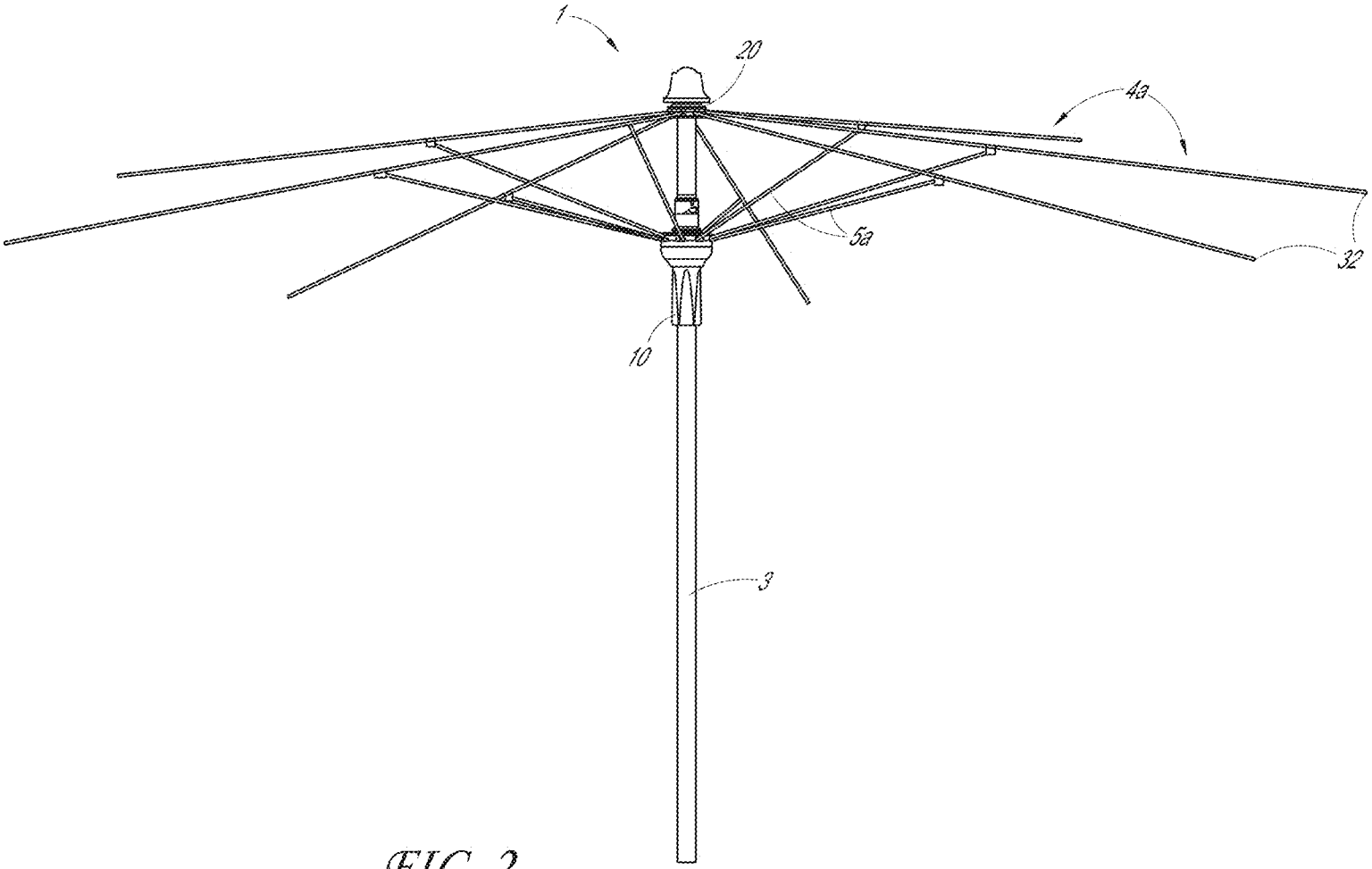
FIG. 2 is an elevation view of one embodiment of an umbrella assembly having a plurality of elongate ribs and struts, an upper hub and a lower hub disposed on an umbrella pole.

Referring to FIG. 2, in some embodiments an umbrella assembly 1 comprises an elongate pole 3, an upper hub 20, and a lower hub 10. The upper hub 20 is disposed on an upper end of the umbrella pole 3. Optionally, the umbrella assembly 1 comprises additional intermediate hubs between the upper and lower hubs (not shown). The lower hub 10 is disposed about the umbrella pole 3 and can be slideably moved along the umbrella pole 3 to open and close a canopy (not shown) that is supported by a plurality of elongate ribs 4*a*. A plurality of struts 5*a* can support the plurality of elongate ribs 4*a*.

Figure 3A:
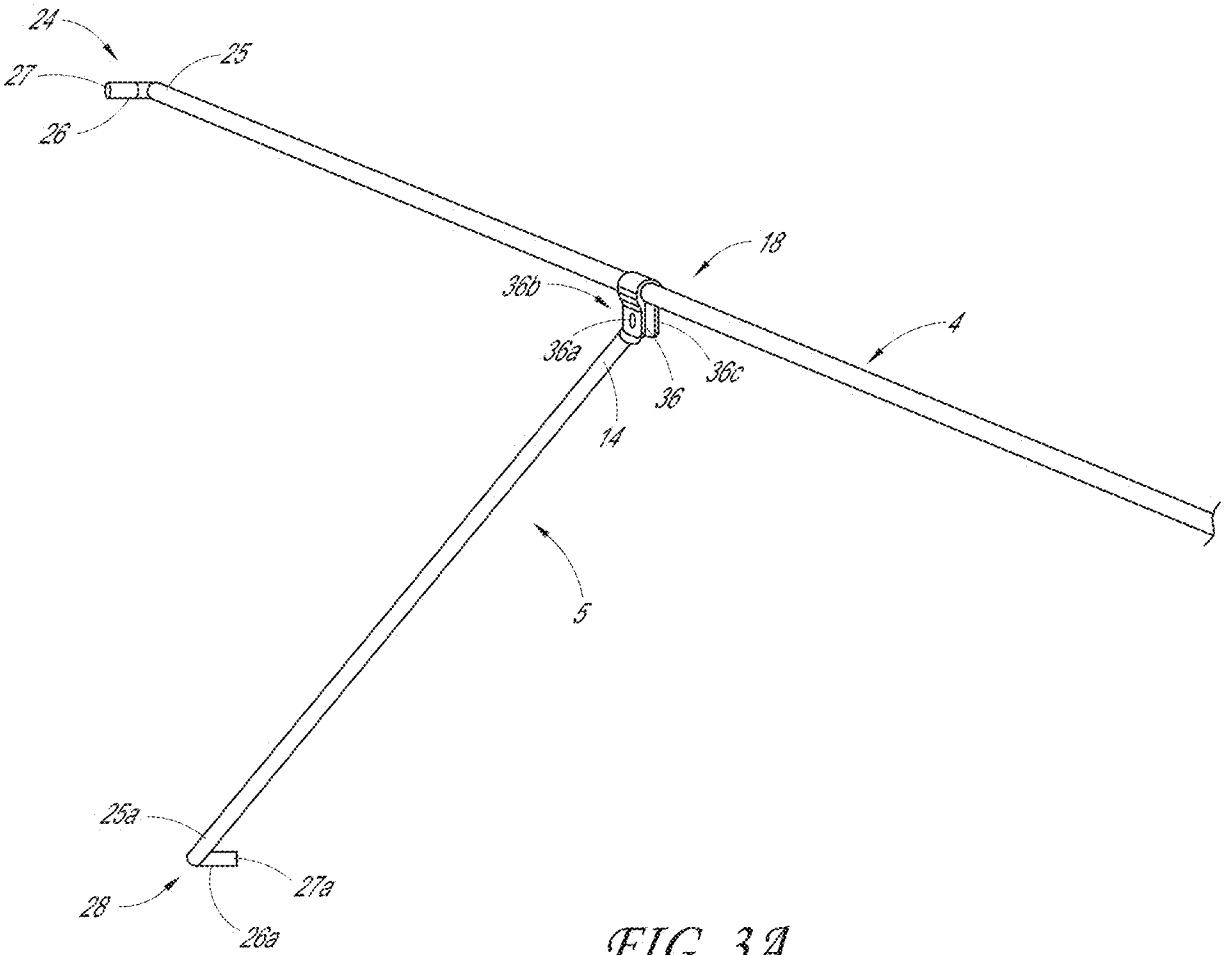
FIG. 3A is a perspective view of one embodiment of an L-shaped elongate rib and an L-shaped elongate strut.
Figure 3B:
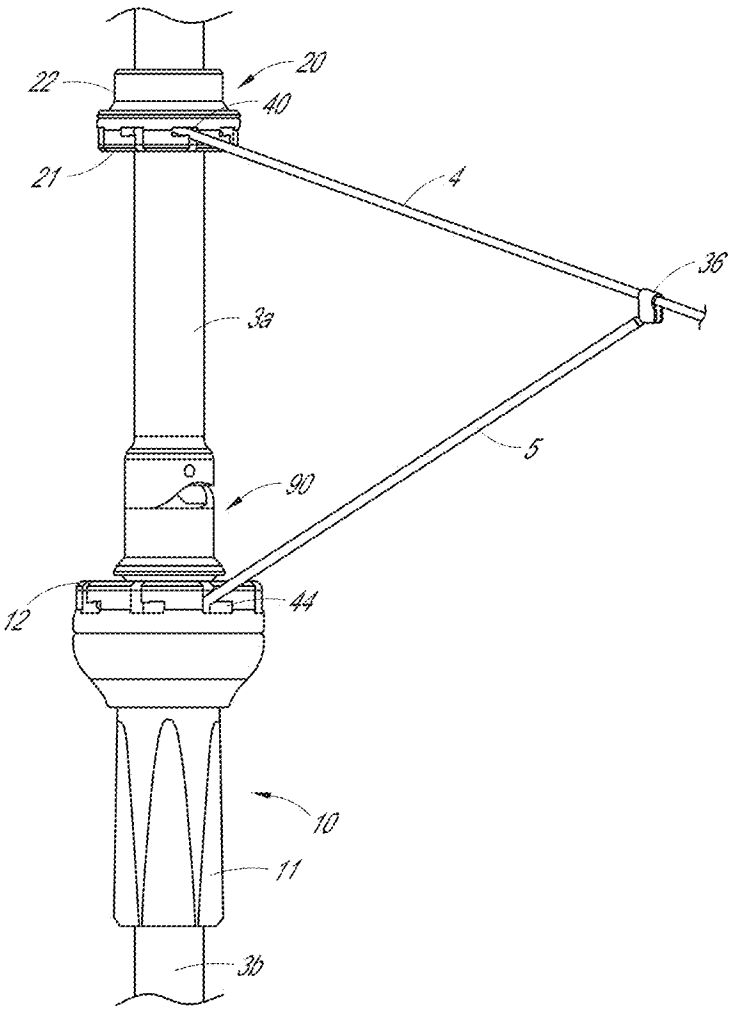
FIG. 3B is an elevation view of the upper hub and the lower hub of the umbrella assembly of FIG. 2 with all but one strut and one rib of the plurality of elongate ribs and struts removed for clarity.

The plurality of elongate ribs 4*a* includes an L-shaped elongate rib 4 as illustrated in FIGS. 3A and 3B. The L-shaped elongate rib 4 can comprise an inner end 24 and an outer end 32, the inner end 24 being pivotally coupled with the upper hub 20. An L-shaped strut 5 of the plurality of struts 5*a* is illustrated in FIGS. 3A and 3B. The L-shaped strut 5 can be pivotally coupled at an inner end 28 with the lower hub 10. An outer end 14 of the L-shaped strut 5 can be pivotally coupled with an intermediate portion 18 of the elongate rib 4. The intermediate portion 18 of the L-shaped elongate rib 4 is disposed between the inner end 24 and the outer end 32 of the L-shaped elongate rib 4.

Referring now to FIG. 3A, in some embodiments, the L-shaped elongate rib 4 pivotably couples at the intermediate portion 18 with the outer end 14 of the L-shaped strut 5. Optionally, the outer end 14 of the L-shaped strut 5 is pivotally coupled with the intermediate portion 18 of the L-shaped elongate rib 4 by a coupler mechanism 36. The coupler mechanism 36 can be pivotably engaged with the intermediate portion 18 such that the coupler mechanism 36 (and/or the L-shaped strut 5) pivots but does not rotate with respect to the intermediate portion 18 or the rest of the L-shaped elongate rib 4. Thus the L-shaped strut 5 can pivot with respect to the L-shaped elongate rib 4. In one embodiment, the coupler mechanism 36 includes a pin 36*a* that extends through a frame 36*b* of the coupling mechanism. The frame 36*b* can extend around the intermediate portion 18 of the L-shaped elongate rib 4 and extend from the intermediate portion on at least one side 36*c*. The pin 36*a* can extend through at least one side 36*c* of the frame 36*b* and through the outer end 14 of the L-shaped strut 5.

In some embodiments, the inner end 24 of the L-shaped elongate rib 4 comprises a radial portion 25 and a lateral portion 26. Optionally, the lateral portion 26 is bent perpendicular or substantially perpendicular to the radial portion 25 or any other suitable angle. The lateral portion 26 can comprise a terminal end 27 of the inner end 24 of the L-shaped elongate rib 4.

In some embodiments disclosed herein, the inner end 28 of the L-shaped strut 5 can comprise the same or similar structure as the inner end 24 of the L-shaped elongate rib 4. Optionally, the inner end 24 and the inner end 28 extend in different directions and in one embodiment extend in opposite direction relative to each other. The inner end 28 of the L-shaped strut 5 can comprise a radial portion 25*a* and a lateral portion 26*a*. Optionally, the lateral portion 26*a* comprises a terminal end 27*a* of the inner end 28 of the L-shaped strut 5.

The lateral portion 26*a* of the inner end 28 of the L-shaped strut 5 can extend transversely, e.g., perpendicularly, to the radial portion 25*a* of the inner end 28 of the L-shaped strut 5. In some embodiments disclosed herein, the lateral portion 26*a* of the inner end 28 extends in a right-hand direction and the lateral portion 26 of the inner end 24 extends in a left-hand direction. One or both of the L-shaped strut 5 and the L-shaped elongate rib 4 can be formed by being bent from a first configuration to a transverse configuration as shown in FIG. 3A. Optionally, the lateral portion 26 of the inner end 24 is pointed opposite to the lateral portion 26*a* of the inner end 28.

Referring to FIG. 3B, many of the plurality of elongate ribs 4*a* and the plurality of elongate struts 5*a* have been removed for simplicity of illustration. In some embodiments, the upper hub 20 is disposed around the umbrella pole 3. Optionally, the upper hub 20 is fixedly engaged with the top portion of the umbrella pole 3. The upper hub 20 can comprise a rib-receiving slot 40 configured to receive the inner end 24 of the L-shaped elongate rib 4. The upper hub 20 can comprise an upper hub body 21 and an upper hub cap 22. The rib-receiving slot 40 can be disposed within the upper hub body 21. Optionally, the upper hub body 21 comprises a plurality of rib-receiving slots 40 disposed around an outer periphery of the upper hub body 21. The upper hub 20 is described in greater detail below in reference to FIGS. 10 and 11.

Still referring to FIG. 3B, in some embodiments the lower hub 10 comprises a lower hub body 11 and a lower hub cap 12. Optionally, the lower hub body 11 comprises a rib-receiving slot 44. The inner end 28 of the L-shaped strut 5 can be received within the rib-receiving slot 44 and pivotally coupled therewith. Optionally, the lower hub body 11 comprises a plurality of rib-receiving slots 44 disposed around an outer periphery of the lower hub body 11.

As discussed further below, the rib-receiving slot 44 of the lower hub 10 receives the inner end 28 of the L-shaped strut 5 when the lateral portion 26*a* of the inner end 28 is disposed in a first direction. The upper hub 20 and the rib-receiving slot 40 receive the inner end 24 of the L-shaped elongate rib 4 when the lateral portion 26 of the inner end 24 of the L-shaped elongate rib 4 is disposed in a second direction. Optionally, the first direction is opposed to the first direction. When the L-shaped strut 5 and the L-shaped elongated rib 4 are thus assembled with the lower hub 10 and the upper hub 20, respectively, the opposing orientations of the first and second directions can overcome the tendency of either the elongate rib or the L-shaped strut 5 to be easily removed or twisted out from within the rib-receiving slots 44 and 40.

In some embodiments, the umbrella pole 3 comprises an upper portion 3*a* and a lower portion 3*b*. A tilt assembly 90 can connect the upper portion 3*a* and the lower portion 3*b* for angling the upper portion 3*a* with respect to the lower portion 3*b* and thereby tilting the canopy of the umbrella assembly.

Figure 3C:
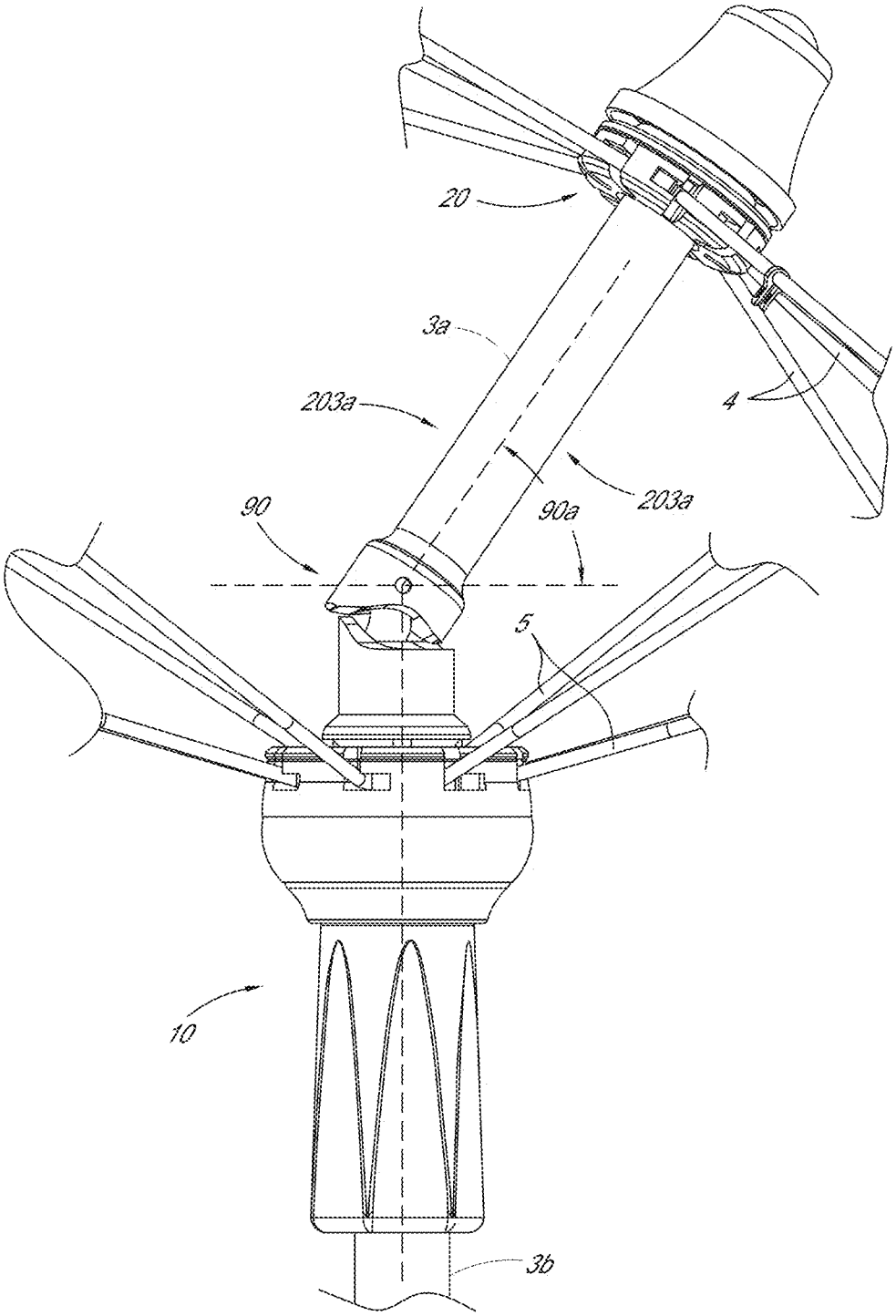
FIG. 3C is an elevation view of the upper hub and the lower hub of the umbrella assembly of FIG. 2 in a tilted configuration.

FIG. 3C illustrates the tilt assembly 90 in a tilted configuration creating an angle 90*a* between the upper portion 3*a* and the lower portion 3*b* of the umbrella pole. The mechanics of the tilt assembly 90 are discussed in greater detail below in reference to FIGS. 13-17. When tilted, the tilt assembly 90 creates the angle 90*a* between the upper portion 3*a* and the lower portion 3*b*. The tilting creates an acute side 203*a* and an obtuse side 203*b* of the umbrella assembly 1.

Figure 4:
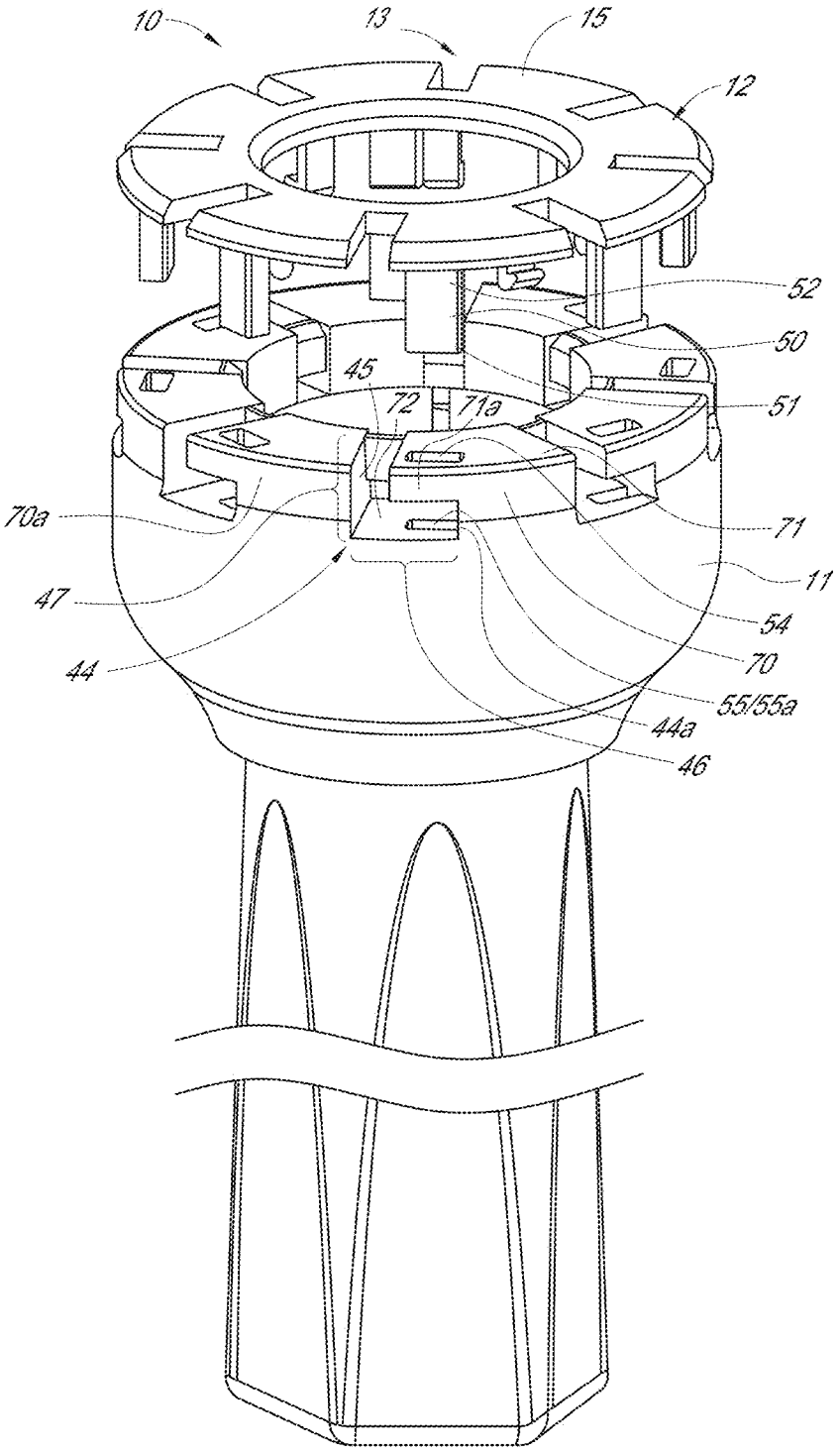
FIG. 4 is an exploded view of one embodiment of the lower hub.

Referring now to FIG. 4, in some embodiments, the lower hub body comprises the rib-receiving slot 44. The rib-receiving slot 44 can comprise a radial portion 47 and a circumferential portion 46. The radial portion 47 can extend along an uninterrupted radial wall 45. The uninterrupted radial wall 45 does not include a recess for receiving a transverse pin of an umbrella structural member, e.g., the strut 5 or another rib. The uninterrupted radial wall 45 does not have any slot configured to (e.g., not being large enough to) receive a transverse pin. As discussed herein, elongate rib and strut members discussed herein preferably have ends that extend in only one direction, e.g., an L-shaped. As such the uninterrupted radial wall 45 need not receive or have a pin or other transverse umbrella rib member extend therethrough. The circumferential portion 46 can extend circumferentially from the radial portion 47 in a clockwise or counterclockwise direction from the perspective of a top view of the lower hub body 11. In the illustrated embodiment, the circumferential portion 46 extends in the counterclockwise direction from the radial portion 47. In some embodiments, the radial portion 47 receives the radial portion 25*a* of the L-shaped strut 5 and the circumferential portion 46 can receive the lateral portion 26*a* of the L-shaped strut 5.

In some embodiments, the lower hub body 11 comprises a plurality of projections 70 containing the rib-receiving slots 44. Each of the projections 70 can comprise an upper surface 71 and the uninterrupted radial wall 45. In some embodiments, the rib-receiving slot 44 is formed between two of the plurality of projections 70. The radial portion of the rib-receiving slot 44 can extend along the uninterrupted radial wall 45 of a first projection 70*a* that is adjacent to a second projection 70. The circumferential portion 46 can then extend under an overhang 71*a* of the upper surface 71 of the second projection 70. The circumferential portion 46 can be further defined by a second radial wall 44*a* of the projection 70 that extends between the overhang 71*a* and the lower surface 72 of the rib-receiving slot 44.

Optionally, the projection 70 defines a blocking member pathway 55*a* that extends through the overhang 71*a* from an aperture 54 on the upper surface 71, to the circumferential portion 46 of the rib-receiving slot 44. In some embodiments, the pathway 55*a* can extend into a lower aperture 55 in the lower surface 72 of the circumferential portion 46.

In some embodiments, the lower hub cap 12 comprises an annular portion 15 disposed about the umbrella pole 3. In some embodiments, the annular portion 15 is flat and has a plurality of blocking members 50 that extend therefrom. Each blocking member 50 can comprise a fixed end 52 coupled with the annular portion 15 and a free end 51. Optionally, the blocking member 50 is configured to be inserted into the aperture 54, through the blocking member pathway 55*a* and to extend down at least into the aperture 55 in the lower portion surface 72.

Optionally, when the blocking member 50 is inserted into the aperture 54 the blocking member blocks access to the circumferential portion 46 or a portion of the circumferential portion 46 for the L-shaped strut 5. If the L-shaped strut 5 is already inserted into the rib-receiving slot 44, the blocking member 50 can prevent the lateral portion 26*a* from being removed out of the slot 44.

Figure 5:
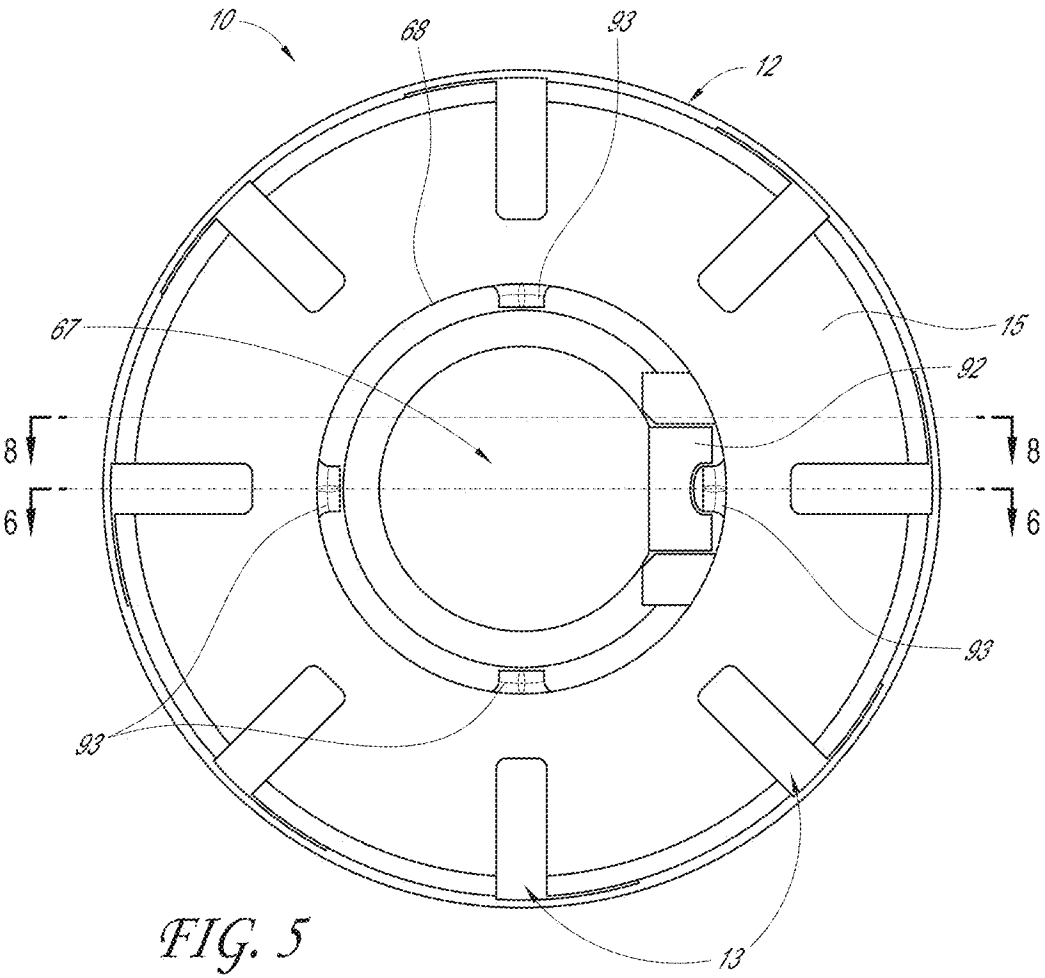
FIG. 5 is a top view of the lower hub of FIG. 4.

Referring now to FIG. 5, in some embodiments, the annular portion 15 of the lower hub cap 12 comprises a plurality of radial cutouts 13. Each of the radial cutout 13 can align with the radial portion 47 of the rib-receiving slot 44 as shown in FIG. 5. The radial cutouts 13 can allow for pivotal movement of the L-shaped strut 5 when inserted into the rib-receiving slot 44. For example, the L-shaped struts 5 can pivot to a position where at least a portion of the radial portion 25*a* of the strut 5 is disposed at least partially in the radial cutout 13.

Lower hub 10 can further comprise a central aperture 67 disposed through the lower hub 10 on a central axis of the lower hub 10. At least one flange 93 can extend radially inward from an interior surface 68 of the lower hub 10 disposed within the central aperture 67. The lower hub body 11 can further comprise a clip assembly 92. The clip assembly 92 can extend radially inward from the interior surface of the lower hub body 11. The flanges 93 and the clip assembly 92 correspond to the tilt assembly 90 as described below in reference to FIGS. 13A and 13B.

Figure 6:
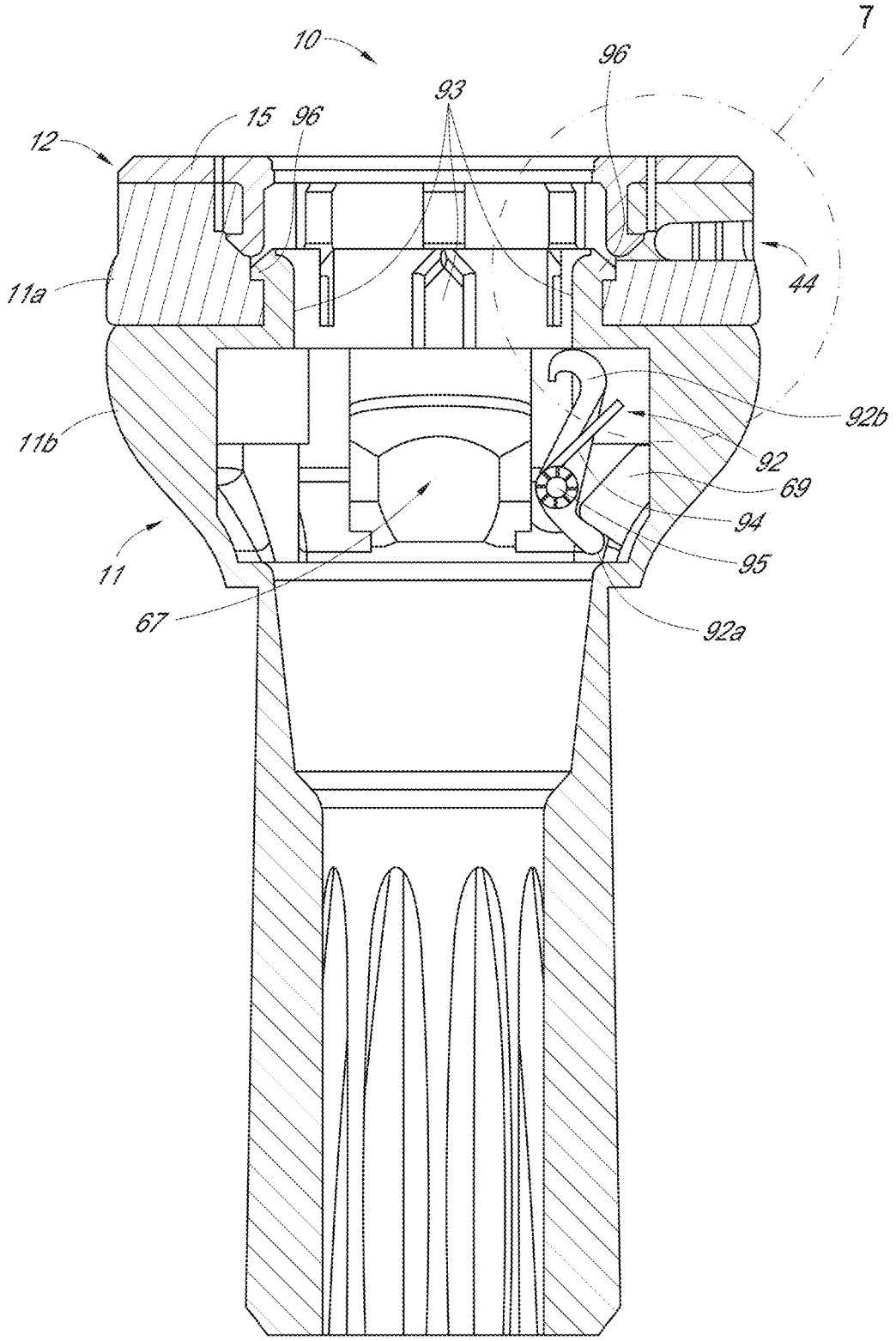
FIG. 6 is a section view taken along the line 6-6 in FIG. 5.
Figure 7:
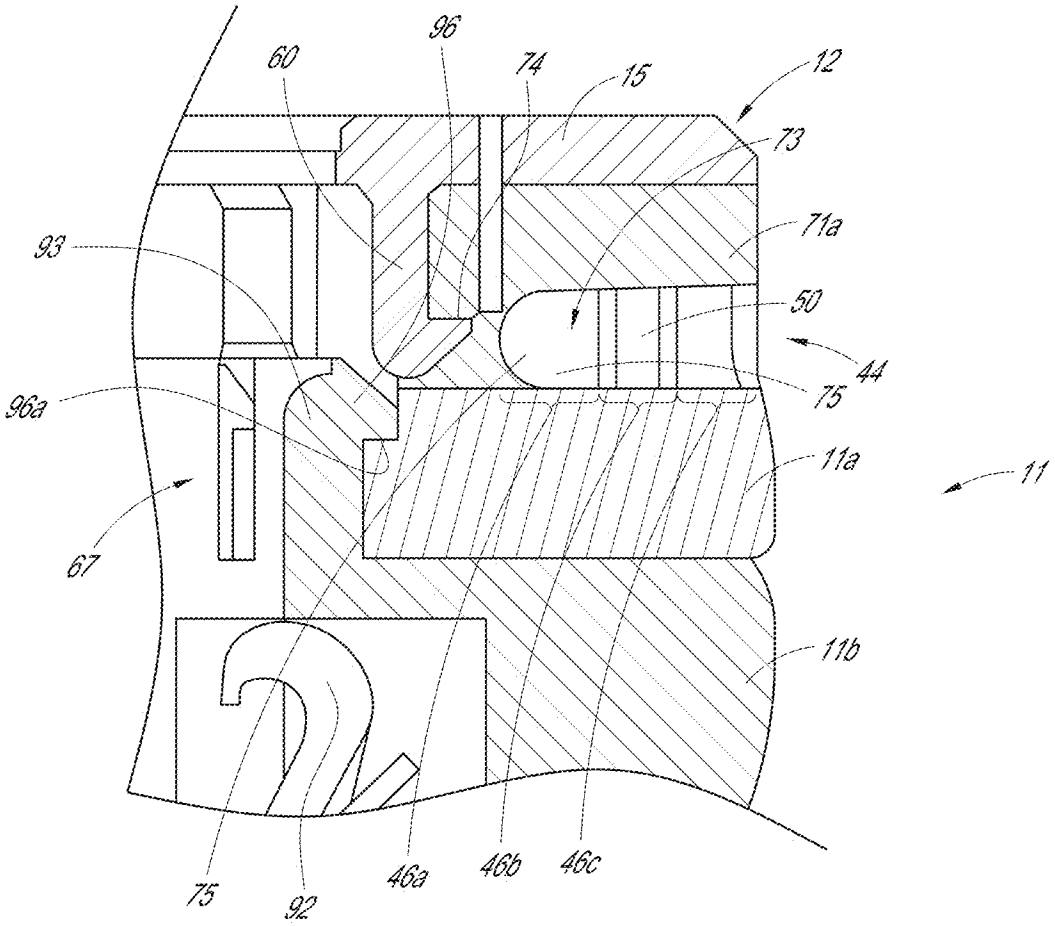
FIG. 7 is a detailed view of detail 7-7 in FIG. 6.

Referring now to FIGS. 6 and 7, in some embodiments, the lower hub cap 12 comprises a cantilevered hook 60. The hook 60 in one non-limiting example of a projection of the cap 12 that can be used to secure the lower hub cap 12 to the lower hub body 11. The lower hub body 11 can comprise a stepped surface 74 of the lower hub body 11. The cantilevered hook 60 can engage the stepped surface 74 when the blocking member 50 is fully inserted into the aperture 54 and thereby the lower hub cap 12 can be engaged with the lower hub body 11.

The circumferential portion 46 can be divided into three zones, a radially inward zone 46*a*, a blocking member zone 46*b* and a radially outward zone 46*c*. The lateral portion 26*a* of the inner end 28 of the L-shaped strut 5 is configured to be trapped within radially inward zone 46*a* by the blocking member 50 when the blocking member 50 is inserted into the blocking member zone 46*b*. A retaining protrusion 73 functions to temporarily hold the inner end 28 of the L-shaped strut 5 within the radially inward zone 46*a* before the blocking member 50 is inserted into the blocking member zone to hold the inner end 28 more securely within the rib-receiving slot 44. Optionally, the radially inward zone 46*a* comprises a rib-receiving space 75 allows the L-shaped strut 5 to pivot within the rib-receiving space 44.

In some embodiments, the lower hub body 11 comprises one integral part as described above. In another embodiment, the lower hub body comprises an upper portion 11*a* and a lower portion 11*b*. The upper portion 11*a* can be disposed between the lower hub cap 12 and the lower portion 11*b*. The upper portion 11*a* can be fixed with respect to the lower portion 11*b* by any mechanical means including, clips, latches, hooks, screws, or other mechanical fasteners and adhesives. The plurality of flanges 93 can be formed as a part of the lower hub body 11.

In some embodiments, the lower portion 11*b* attaches to the upper portion 11*a* by at least one lower body cantilever hook 96 extending from the lower portion 11*b* to a lower hub stepped surface 96*a*. Optionally, a plurality of lower body cantilever hooks 96 can be spaced around the central aperture 67. This attachment mechanism allows the lower portion 11*b* to rotate freely with respect to the upper portion 11*a*. Alternatively the positions of the cantilever hook 96 and the lower hub stepped surface may be switched. Optionally, one of the flanges 93 can extend radially inward from the lower body cantilever hook 96.

The clip assembly 92 can comprise an engagement end 92*b* extending along a shaft from a pivot member 95. A tail end 92*a* extends from the clip assembly 92. The pivot member 95 pivotably attaches the clip assembly 92 to the lower hub body 11. The pivot member 95 can be pivotally engaged with the lower hub body 11 and in some cases the lower portion 11*b* of the lower hub body 11. A spring 94 can be mounted on the pivot member 95 or elsewhere on the clip assembly 92 to extend the engagement end 92*b* radially inward into the central aperture 67. Optionally the spring 94 is a wire spring coiled about the pivot member 95. The tail end 92*a* can be biased against a block 69 extending from the interior surface 68 by the spring 94 and thereby limiting the extent to which the engagement end 92*b* can extend into the central aperture 67. Together the spring 94 and the tail end 92*a* with the block 69 function to keep the clip assembly 92 extended into the central aperture 67 within a set range of distances. This set range of distances can be optimized for the engagement end 92*b* of the clip assembly 92 to removably engage with a lip 99*e* of a lower cam member 99 of the tilt assembly 90 as described further in reference to FIGS. 13A and 13B.

Figure 8:
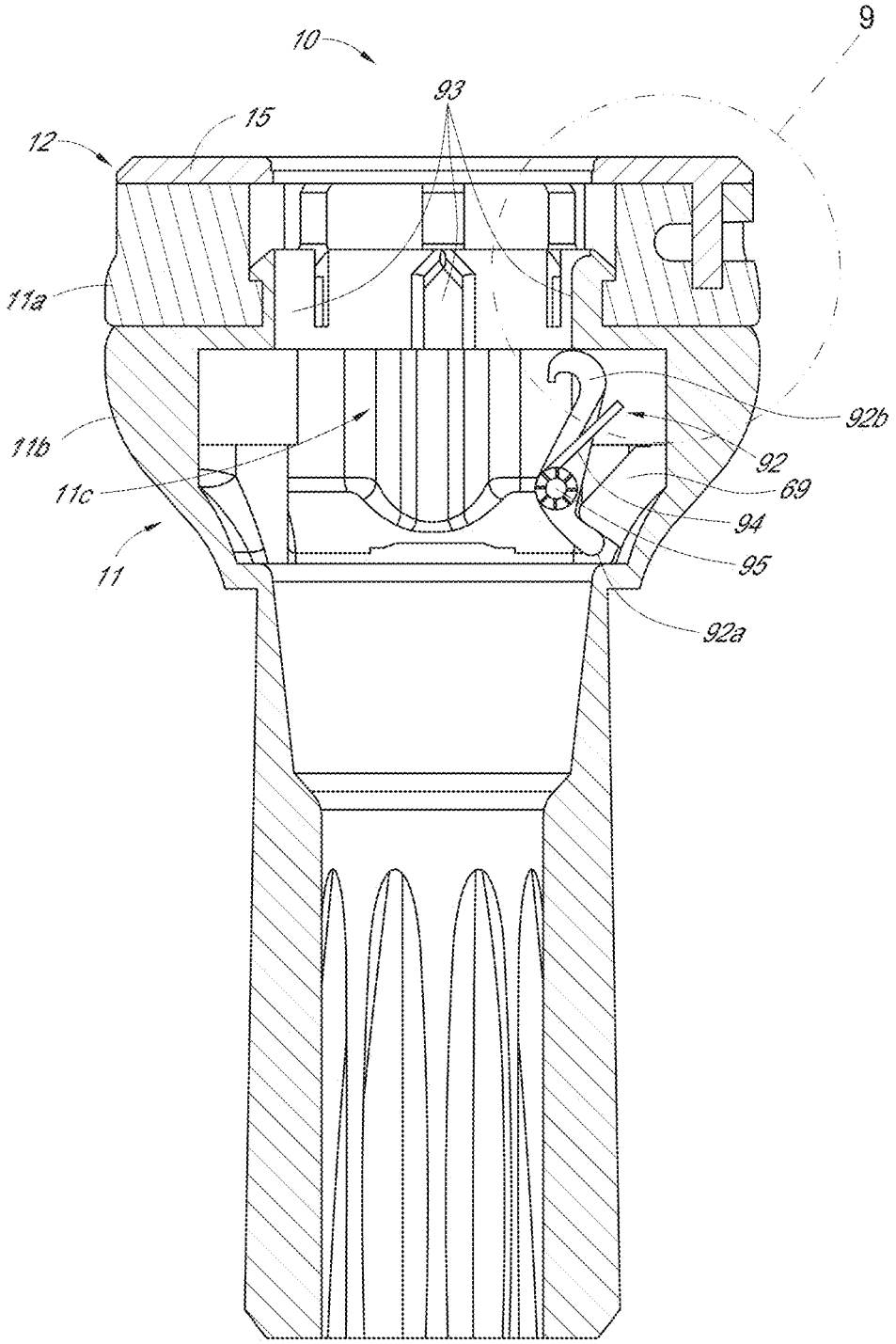
FIG. 8 is a section view taken along the line 8-8 in FIG. 5.
Figure 9:
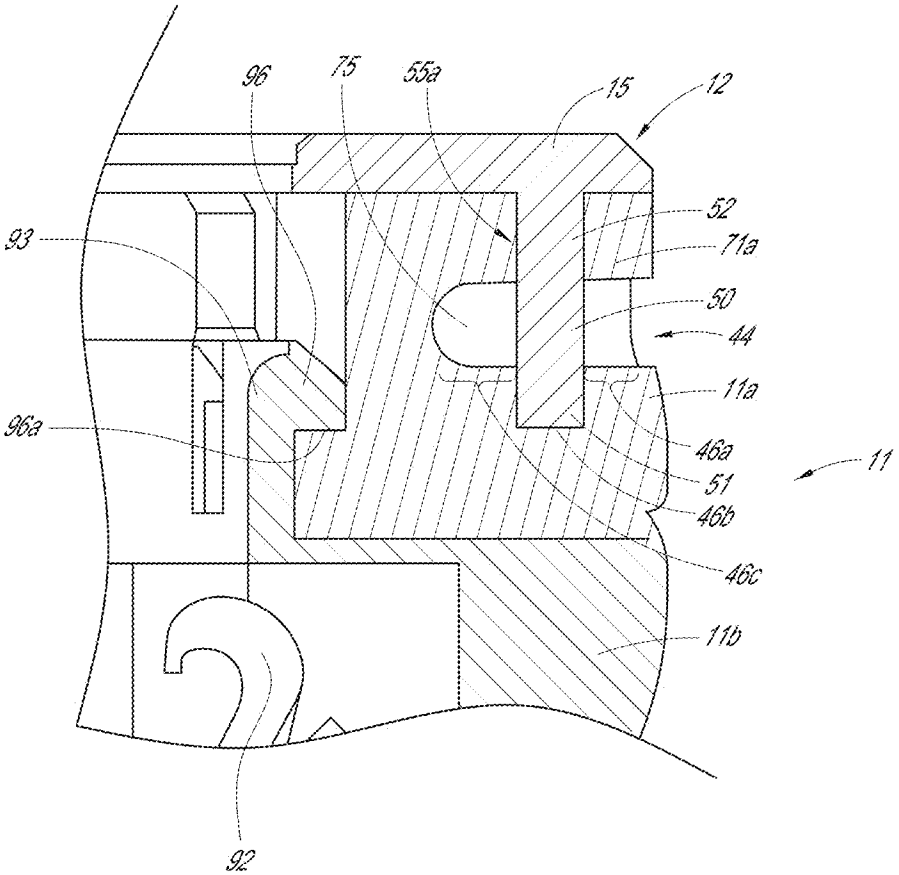
FIG. 9 is a detailed view taken at the detail 9-9 in FIG. 8.

Referring to FIGS. 8 and 9, the blocking member 50 can extend through the circumferential portion 46 of the rib-receiving slot 44 and into the lower aperture 55. This configuration has the advantage of creating a stronger trapping mechanism for the inner end 28 of the L-shaped strut 5 within the rib-receiving space 75. The expanse of material below the lower aperture 55 supports the free end of the blocking member 50 against deflection under, for example, radial loads applied by the lateral portion 26*a* of the L-shaped strut 5.

Figure 10:
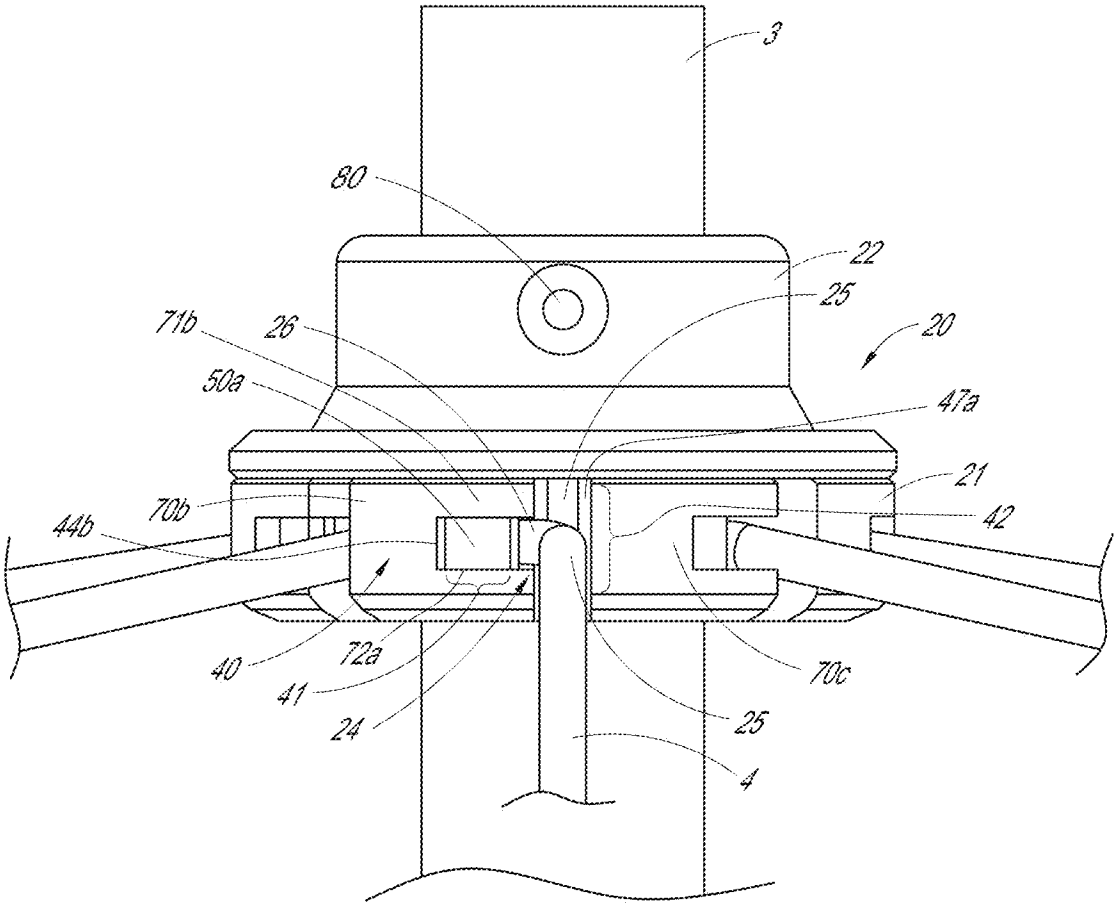
FIG. 10 is a perspective view of the upper hub and the L-shaped elongate rib of the umbrella of the umbrella assembly of FIG. 2.
Figure 11:
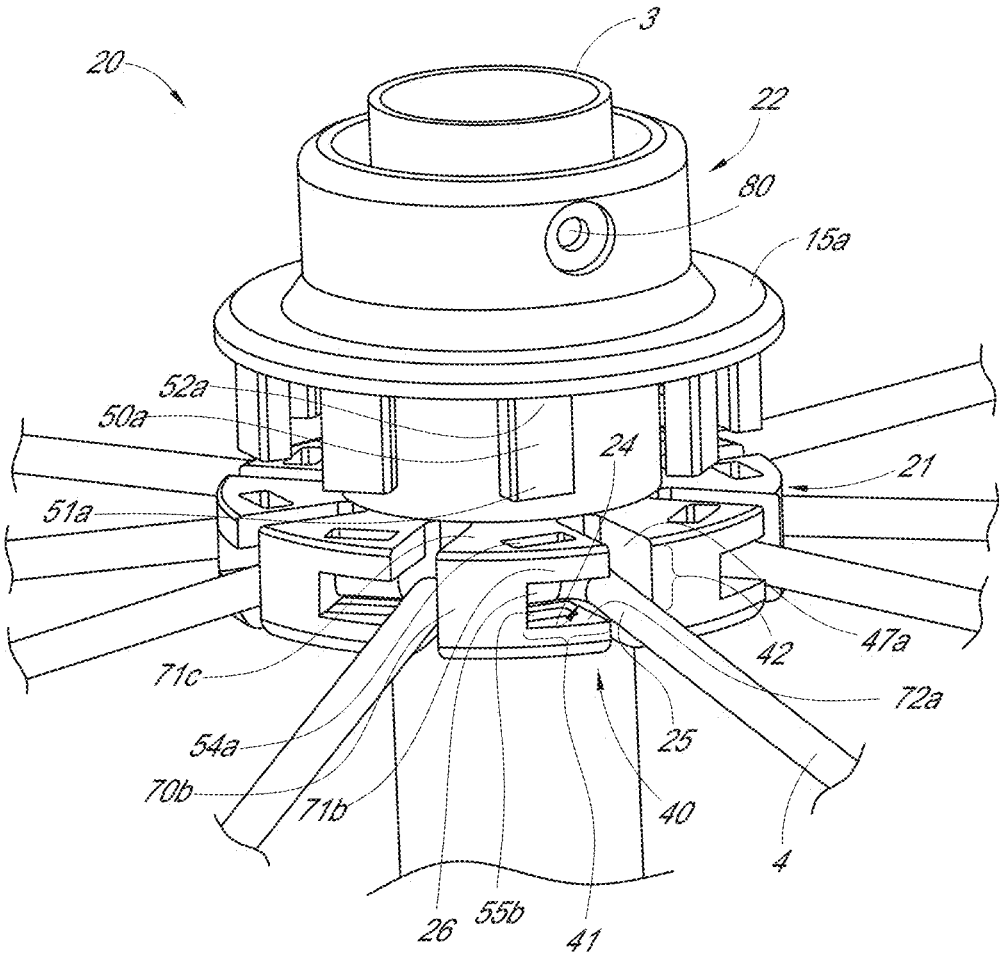
FIG. 11 is an exploded view of the upper hub of the umbrella assembly of FIG. 2.
Figure 12B:
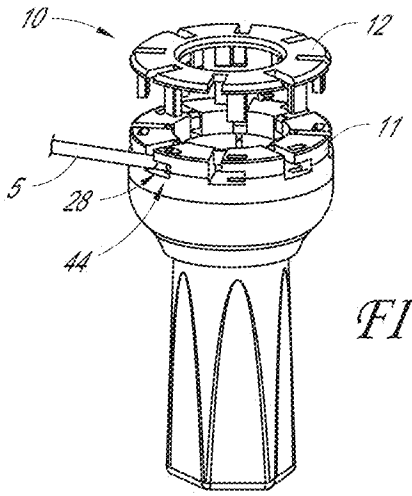
FIGS. 12A-D illustrate a method of assembling the lower hub with an L-shaped strut.
Figure 12A:
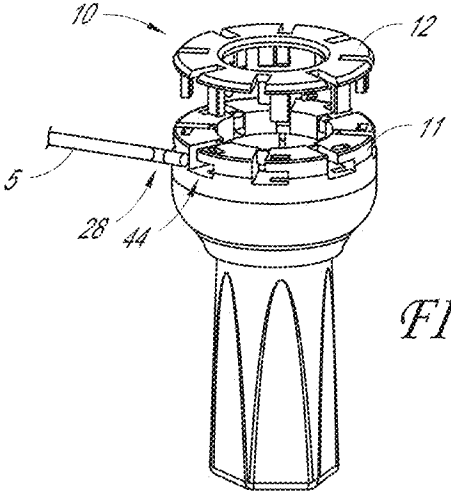
Figure 12D:
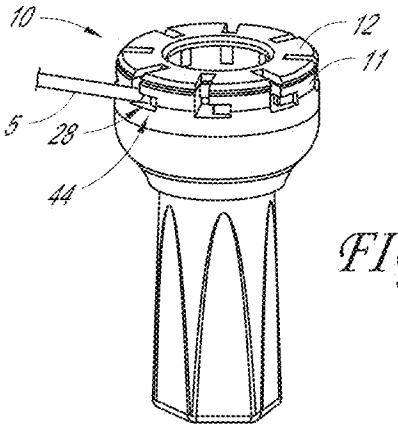
Figure 12C:
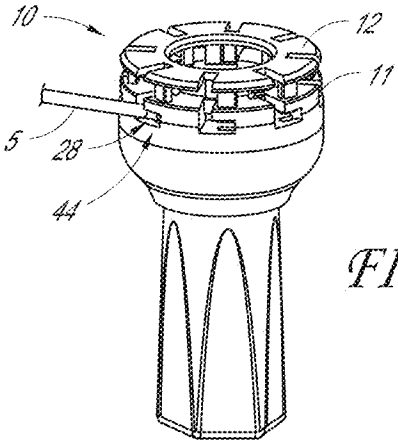
Figure 13A:
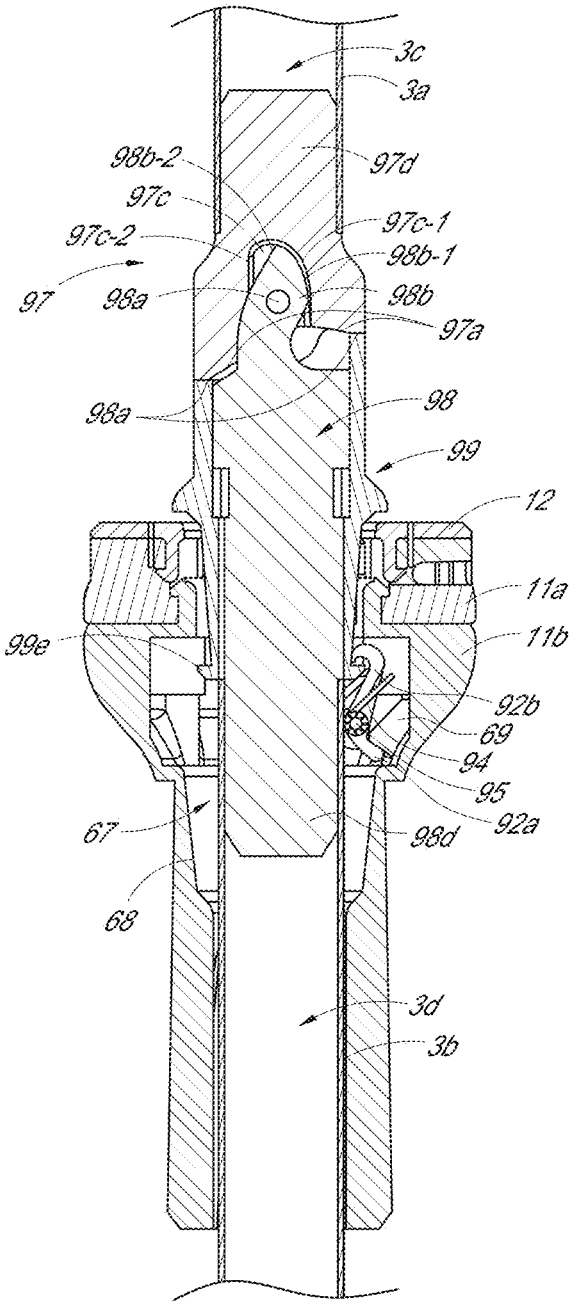
FIG. 13A is a section view taken through a center line of the umbrella assembly of FIG. 2 including a tilt assembly.
Figure 13B:
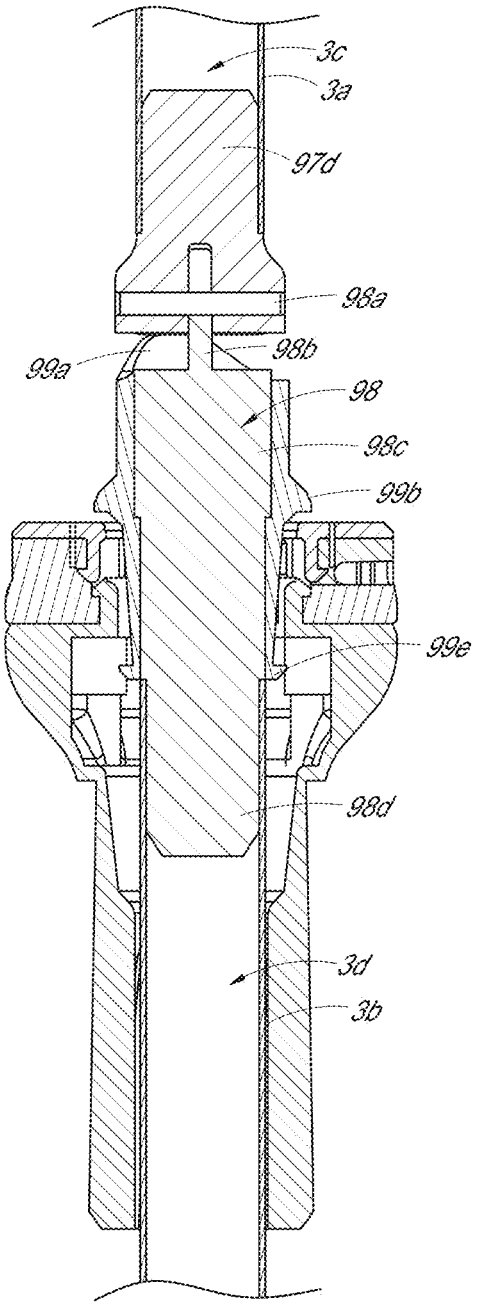
FIG. 13B is a section view taken orthogonal to the section view of FIG. 13A.
Figure 13C:
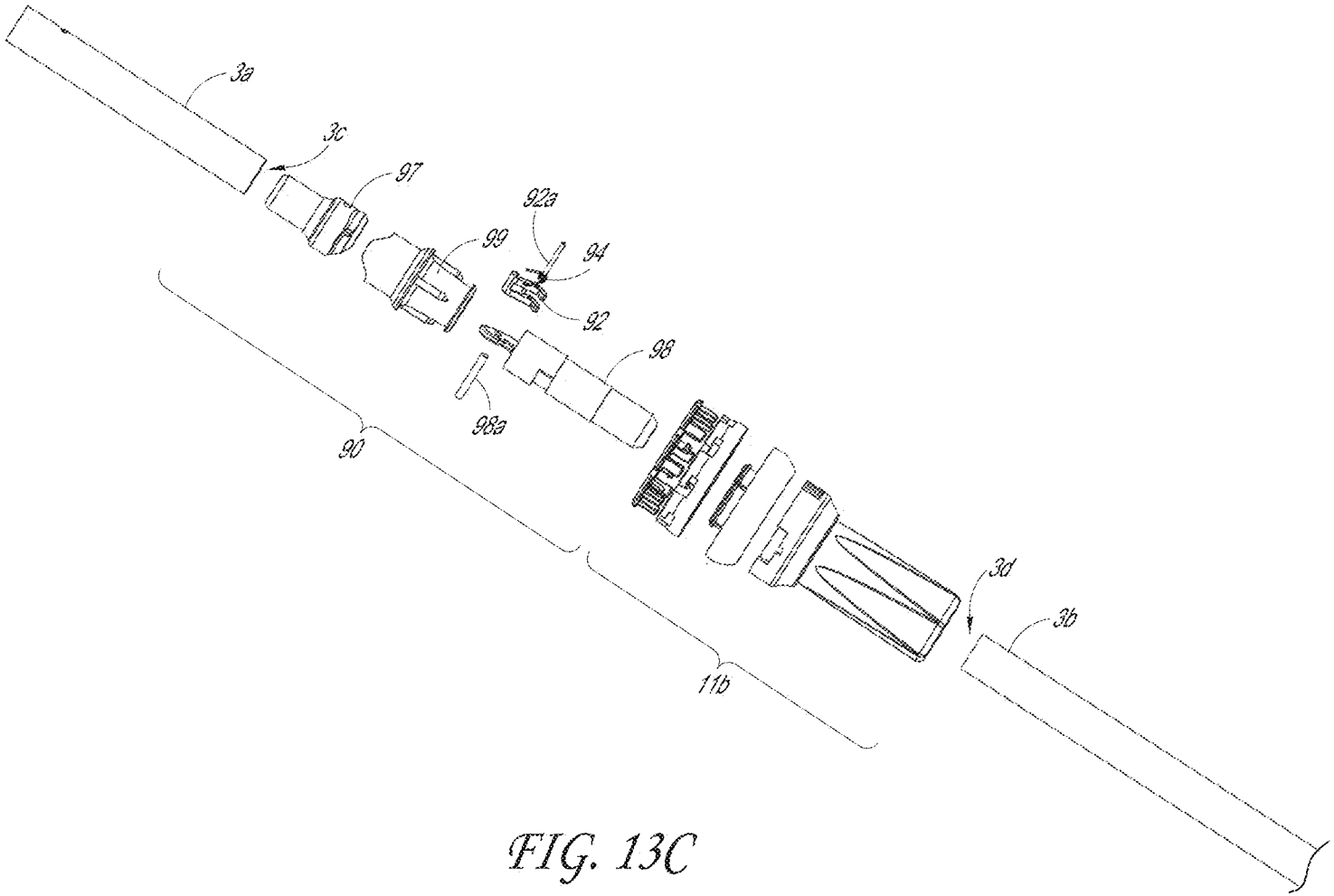
FIG. 13C is an exploded assembly view of the umbrella assembly of FIG. 2 including the tilt assembly.
Figure 14:
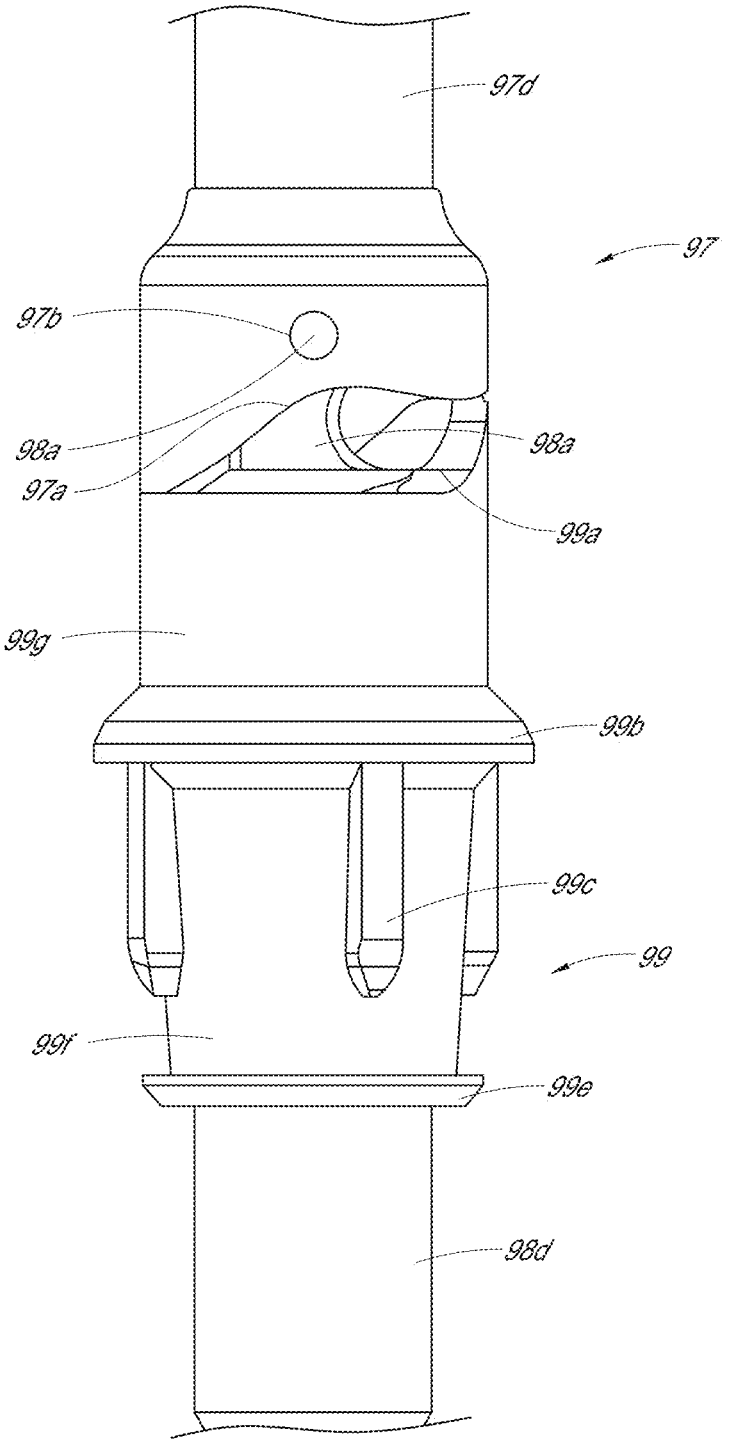
FIG. 14 is an elevation view of the tilt assembly.

Referring now to FIGS. 10 and 11, in some embodiments, the upper hub 20 comprises the rib-receiving slot 40. The rib-receiving slot 40 comprises a circumferential portion 41 and a radial portion 42. Similar to the lower hub 10, the upper hub 20 can comprise the rib-receiving slot 40 having the circumferential portion 41 with a radially outward zone (similar to radially outward zone 46*c*), a radially inward zone (similar to radially inward zone 46*a*, and a blocking member zone (similar to blocking member zone 46*b*) disposed between the radially inward and outward zones. The radial portion 42 extends along an uninterrupted radial wall 47*a* of the upper hub 20. The uninterrupted radial wall 47*a* optionally does not include a recess for receiving a transverse pin of an umbrella structural member, e.g., the rib 4 or another rib. Optionally, the rib-receiving slot 40 is created between two adjacent projections of the plurality of projections. One of the plurality of projections 70*b* can comprise the uninterrupted radial wall 47*a* and the other of the adjacent projections 70*c* can comprise the circumferential portion 41 of the rib-receiving slot 40. Optionally, the projection 70*b* corresponding to the circumferential portion 41 comprises an aperture 54*a* that extends from an upper surface 71*c* of the projection 70*b* into the circumferential portion 41 of the upper hub body 21. More particularly, the upper surface 71*c* of the circumferential portion 41 can be defined by an overhang 71*b* that comprises a circumferential extension of the upper surface 71*c*. The circumferential portion 41 can be further defined on a circumferential boundary by a second radial wall 44*b* of the projection 70*b* that extends between the overhang 71*b* and a lower surface 72*a* of the circumferential portion 41.

Optionally, the upper hub cap 22 comprises an annular member 15*a* and at least one blocking member 50*a* extending from the annular member 15*a*. The blocking member 50*a* can include a fixed end 52*a* coupled with the annular member 15*a*. The blocking member 50*a* can extend from the fixed end 52*a* to a free end 51*a*. The free end 51*a* can extend into the aperture 54*a* and through the overhang 71*b*. The blocking member 50*a* can thereby pass into the rib-receiving slot 40 of the upper hub body 21. A retaining protrusion (not shown) of the circumferential portion 41, similar to the retaining protrusion 73 of the lower hub 10, can extend into the rib-receiving slot 40. The retaining protrusion can temporarily maintain the lateral portion 26 of the L-shaped elongate rib within a rib-receiving space. Optionally, a lower aperture 55*b* can be within the lower surface 72*a* of the circumferential portion 41.

In some embodiments, the upper hub cap 22 is coupled with the upper hub body 21 by means of cantilevered hooks. In other embodiments, the upper hub body 21 is coupled with the upper hub cap 22 by a detent feature 80. The detent feature 80 can comprise a hole through the annular member 15*a* of the upper hub cap 22 and at least partially into one or both of the umbrella pole 3 or the upper hub body 21. A pin (not shown) can be inserted at least partially into the hole or other coupling detent to secure the upper hub cap 22 and the upper hub body 21 together. In some embodiments, connection between the upper hub body 21 and the umbrella pole 3 can be by way of a coupling or detent feature 80.

Referring now to FIGS. 12*a*-12*d*, these figures illustrate a method according to an aspect of the present disclosure for inserting the inner end 28 of the L-shaped strut 5 into the rib-receiving slot 44 of the lower hub end. Although described in terms of the L-shaped strut 5 and the lower hub 10, the methods herein described can be equally applied to the L-shaped elongate rib 4 and the upper hub 20.

A method of assembling the umbrella assembly 1 can comprise any combination of the steps described below. A user provides the lower hub 10 as described above and illustrated in FIGS. 4-9, with the lower hub cap 12 and lower hub body 11 wherein the rib-receiving slot 44 is disposed in the lower hub body 11. The lower hub body 11 comprising the circumferential portion 46. The user provides the L-shaped strut 5. The user orients the inner end 28 of the L-shaped strut 5 such that the lateral portion 26*a* is aligned corresponding to the circumferential portion 46 of the rib-receiving slot 44. The user opens the rib-receiving slot 44 by removing the blocking member 50 from the circumferential portion 46 of the rib-receiving slot 44. In another option, the blocking member is not initially present and this step is unnecessary. The user optionally removes the blocking member 50 from the aperture 54. The user advances the lateral portion 26*a* of the L-shaped strut 5 into the circumferential portion 46 of the rib-receiving slot 44. The lower hub body 11 temporarily maintaining the lateral portion 26*a* within the rib-receiving space 75, optionally by the retaining protrusion 73. The user inserts the free end 51 of the blocking member 50 into the rib-receiving slot 44 through the blocking member pathway 55*a* to at least partially block the circumferential portion 46 and trap the lateral portion 25 of the L-shaped strut 5 within the radially inward zone 46*a* of the rib-receiving slot 44.

The user provides the upper hub 20, such as the hub illustrated in FIGS. 10 and 11, the upper hub 20 having the upper hub body 21 and the upper hub cap 22, the upper hub body 21 comprising the rib-receiving slot 40 and having the circumferential portion 41. The user provides the L-shaped elongate rib 4. The user opens the rib-receiving slot 40 by removing the blocking member 50*a* from the circumferential portion 41 of the rib-receiving slot 40. The user optionally removes the blocking member from the aperture 54*a*. The user aligns the inner end 24 of the L-shaped elongate rib 4 with the inner end 28 of the L-shaped strut 5 such that the lateral portion 26 is pointed in an opposite direction to the lateral portion 26*a* of the strut 5. The user advances the lateral portion 26 of the L-shaped elongate rib 4 into the circumferential portion 41 of the rib-receiving slot 40. The upper hub 10 temporarily maintaining the lateral portion 26 within the rib-receiving space, optionally by the retaining protrusion (not shown). The user inserts the free end 51*a* of the blocking member 50*a* into the rib-receiving slot 40 through the lower aperture 55*b* to at least partially block the circumferential portion 41 and trap the lateral portion 26 of the L-shaped elongate rib 4 within the radially inward zone of the rib-receiving slot 40. The user secures the upper hub cap 22 to the upper hub body 21 by inserting the pin into the detent mechanism 80. The user secures the lower hub cap 12 to the lower hub body 11 by hooking the cantilever hook 60 extending from the lower hub cap 12 onto the stepped surface 74. The user pivotably couples the intermediate portion 18 of the L-shaped elongate rib 4 with the outer end 14 of the L-shaped strut 5 with the coupling mechanism 36.

As illustrated in FIGS. 3B and 3C, the umbrella assembly 1 can optionally comprise the tilt assembly 90 on the umbrella pole 3. The upper hub 20 can be on the upper portion 3*a* and the lower hub 10 can be on the lower portion 3*b*. The tilt assembly 90 joins the upper portion 3*a* with the lower portion 3*b* of the umbrella pole 3. FIG. 3B illustrates the tilt assembly 90 (and the umbrella assembly 1) in a neutral configuration with the upper portion 3*a* and the lower portion 3*b* substantially aligned. FIG. 3C illustrates the tilt assembly 90 (and the umbrella assembly 1) in a tilted configuration with the upper portion 3*a* set at the angle 90*a* relative to the lower portion 3*b*.

In some embodiments, the tilted configuration of the tilt assembly 90 causes the L-shaped elongate ribs 4 and the L-shaped struts 5 to be repositioned with respect to their positions relative to the upper hub 20 and the lower hub 10, respectively when in the neutral configuration as compared to their positions when in the tilted configuration. Specifically, in some embodiments, the L-shaped elongate struts 5 when in the tilted configuration are lowered with respect to their neutral position in the rib-receiving slots 40 on the acute side 203*a* of angle 90*a* and raised on the obtuse side 203*b* with respect to the lower hub 10. The converse can be true for the L-shaped elongate ribs 4 that extend from the upper hub 20. The ribs 4 can be raised with respect to their neutral position in the rib-receiving slots 44 on the acute side 203*a* of angle 90*a* and lowered on the obtuse side 203*b* with respect to the lower hub 10. This allows for a greater range of motion between the neutral and tilted configurations and reduces stress in the L-shaped struts 5 and elongate ribs 4.

The tilting of the upper portion 3*a* with respect to the lower portion 3*b* of the pole 3 about the joint 90 to form the angle 90*a* can act to place the L-shaped ribs and struts 4, 5 into tension and/or compression. The repositioning of the L-shaped ribs and struts 4, 5 can create a compressive force acting along the L-shaped elongate rib 4 on the acute side 203*a* and/or a tension force acting along the L-shaped strut 5 on the acute side. The compressive force can act between the inner end 24 and the intermediate portion 18 of the L-shaped rib. The intermediate portion 18 is where the coupler mechanism 36 can attach the outer end 14 of the L-shaped strut 5 with the L-shaped elongate rib 4. This compression force on the L-shaped elongate rib 4 can place the L-shaped strut 5 into tension between the inner and outer ends 28, 14. Corresponding, but reversed, compressive and tension forces can act on L-shaped ribs and struts 4, 5 on the obtuse side 203*b*, only with the compressive and tension forces reversed.

The compressive and tension forces on the L-shaped ribs and struts 4, 5 can act, to one degree or another, on almost all of the pluralities of L-shaped ribs and struts 4*a*, 5*a*. These compressive and tension forces can act to resist the tilting of the upper portion 3*a* with respect to the lower portion 3*b* of the pole 3 to form the angle 90*a*. The compressive and tension forces can also act to return the upper portion 3*a* back into an upright position with respect to the lower portion 3*b*, depending on the degree of bending and the stiffness of the L-shaped ribs and struts 4, 5.

Ribs and struts of the pluralities of L-shaped ribs and struts 4*a*, 5*a* that are orthogonal to the angle 90*a* can be placed under a moment, or twisting force. As the upper portion 3*a* tilts with respect to the lower portion 3*b* of the pole 3, the upper hub 20 tilts, while the lower hub 10 is maintained in place. In the tilted position, the interior surfaces of the rib-receiving slot 40 of the upper hub 20 can act on the lateral portion 26 of the inner end 24 of the L-shaped elongate rib 4, placing the L-shaped elongate rib 4 under a first moment. In the tilted position, the interior surfaces of the rib-receiving slot 44 of the lower hub 10 can act on the lateral portion 26*a* of the inner end 28 of the L-shaped strut 5, placing the L-shaped strut 5 under a second moment. The first and second moments are opposite in directions, in some embodiments. The first and second moments can act to resist the tilting of the tilt assembly 90 and/or to return the upper portion 3*a* to the upright position with respect to the lower portion 3*b* of the pole 3.

FIGS. 13A-17 show the tilt assembly 90 comprising an upper cam member 97, a lower cam member 99 and a pivotal coupler member 98. The upper cam member 97 comprises an upper cam surface 97*a*, a pivot location 97*b*, a pivot chamber 97*c*, an engagement protrusion 97*d*, and an exterior surface 97*e*. The upper cam member 97 is also illustrated and described in reference to FIG. 15. Lower cam member 99 optionally comprises any combination or subcombination of a lower cam surface 99*a*, a stop ring 99*b*, a plurality of protrusions 99*c*, a central passage 99*d*, a lip 99*e*, an outer surface 99*f*, and an upper cylindrical portion 99*g*. The lower cam member 99 is illustrated and described in greater detail in reference to FIGS. 16A and B. The pivotal coupler member 98 optionally comprises any combination or subcombination of a pin 98*a*, a contoured extension member 98*b*, an exterior surface 98*c*, an engagement protrusion 98*d*, a rotation slot 98*e* and an upper surface 98*f*. The pivotal coupler member 98 is illustrated and described in greater detail in reference to FIG. 17.

The engagement protrusion 97*d* of the upper cam member 97 couples either removably or permanently with the upper portion 3*a* of the umbrella pole 3. Optionally the engagement protrusion 97*d* is sized to fit within the interior 3*c* of the upper portion 3*a*. The engagement protrusion 97*d* can extend a distance into the interior 3*c* of the upper portion 3*a* of the umbrella pole 3 so that the upper cam member 97 is rigidly and securely engaged with the upper portion 3*a*. Optionally the engagement protrusion 97*d* can be mechanically fastened to the upper portion 3*a* by a mechanical fastener such as a rivet or bolt.

Figure 15:
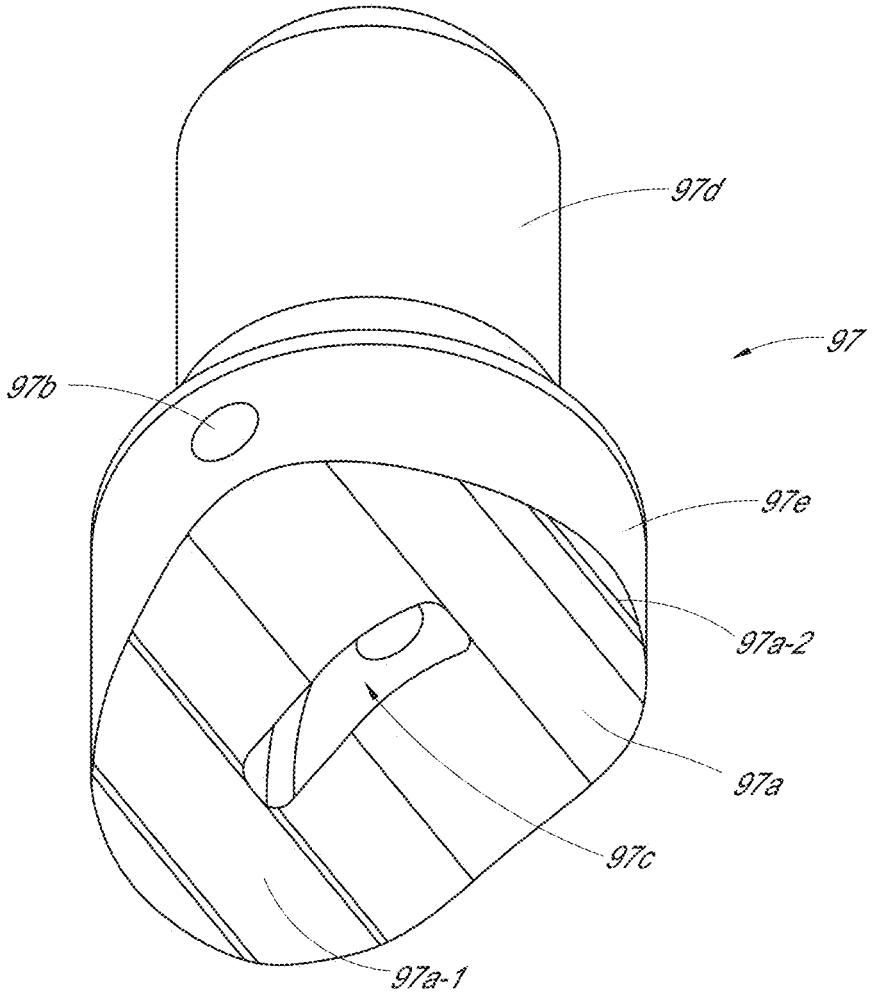
FIG. 15 is a perspective view of an upper cam member.
Figure 16A:
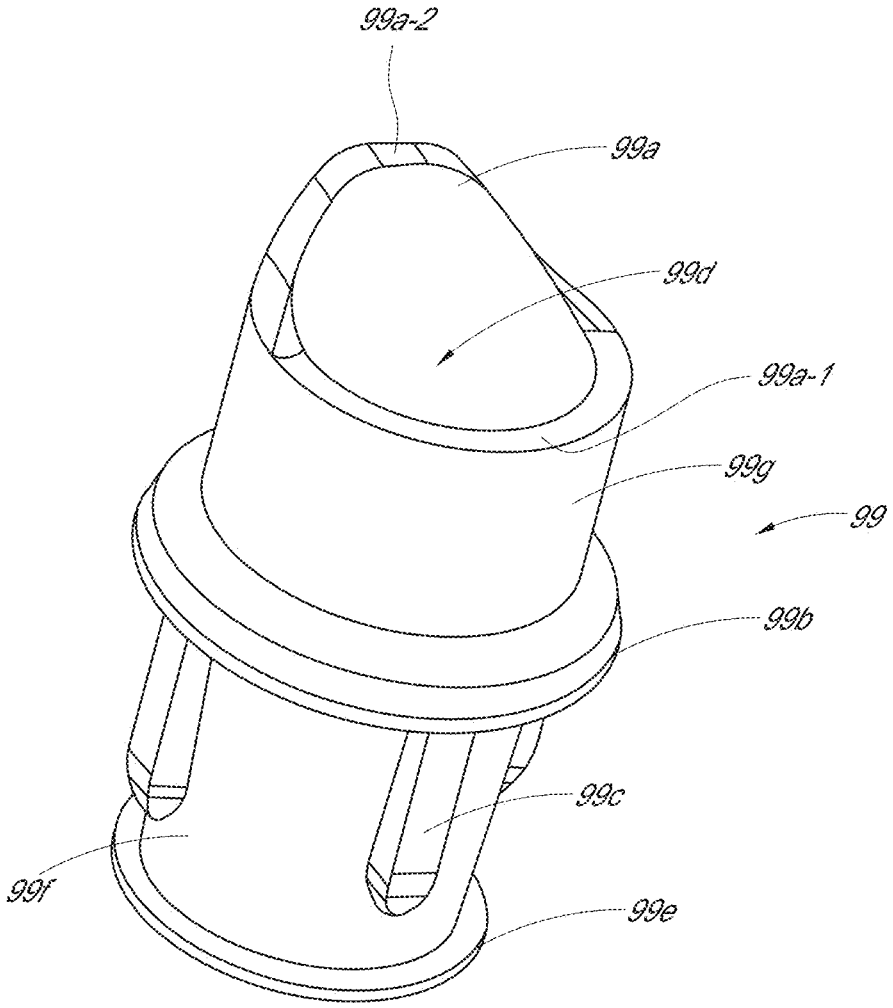
FIG. 16A is a perspective view of a lower cam member.
Figure 16B:
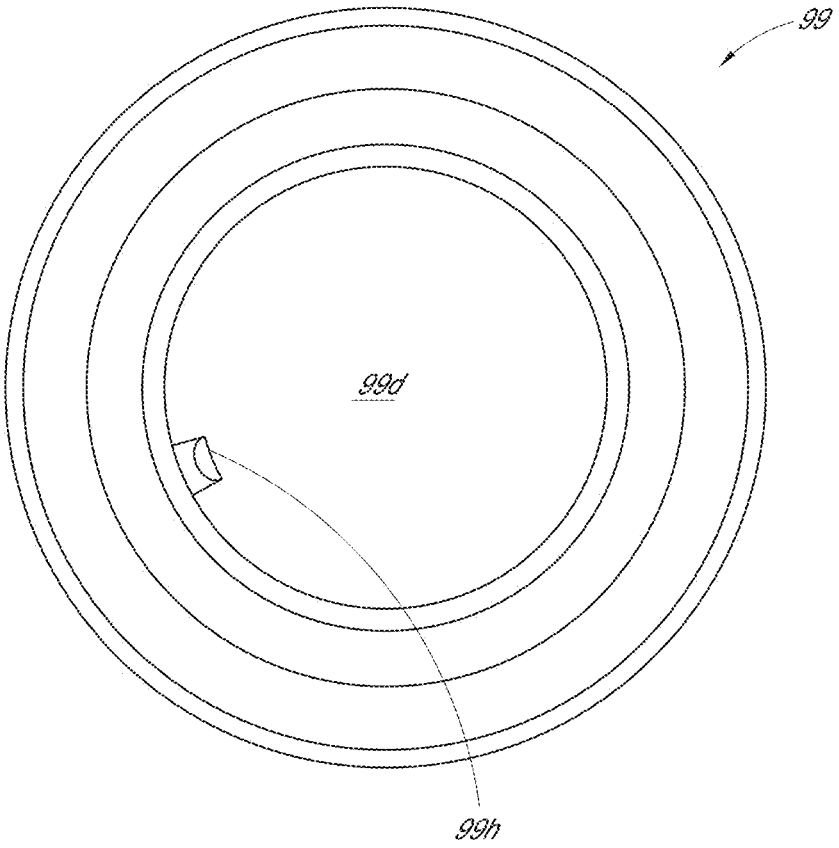
FIG. 16B is a top view of the lower cam member.
Figure 17:
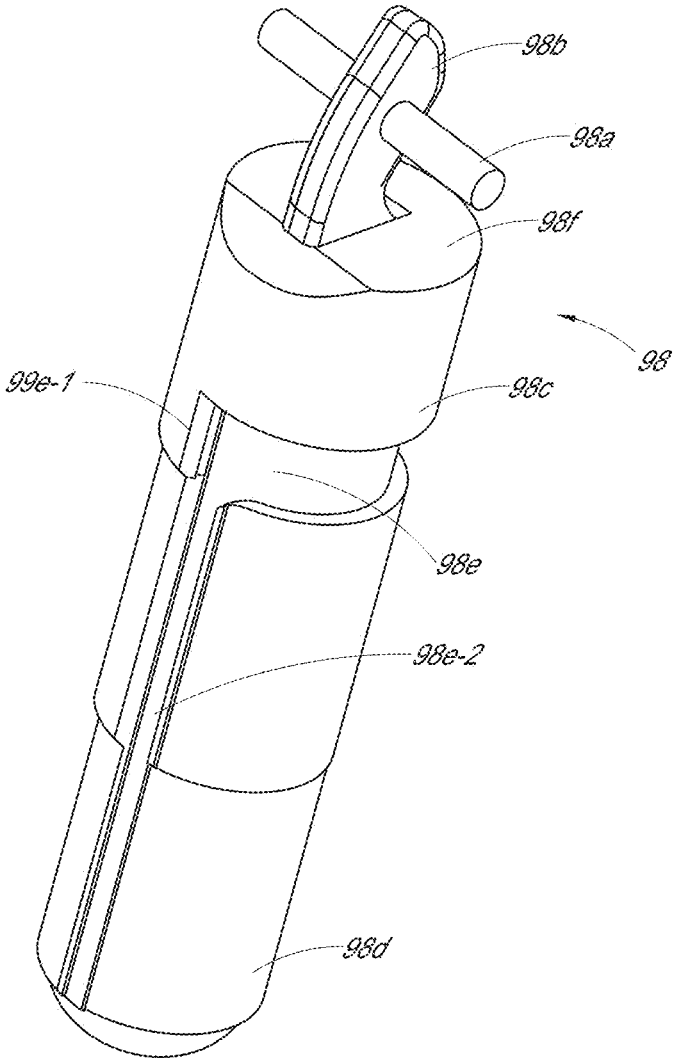
FIG. 17 is a perspective view of a pivotal coupler member.

The upper cam surface 97*a* as illustrated in FIG. 15 can comprise an extended section 97*a*-1 and a lowered section 97*a*-2. The lowered section 97*a*-2 can be at a higher location than the extended section 91*a*-2 in the umbrella assembly 1. The upper cam surface 97*a* can interface and interact with the corresponding lower cam surface 99*a* to move the umbrella assembly 1 between the neutral configuration and the tilted configuration, the lower cam surface 99*a* having a lowered portion 99*a*-1 and an extended portion 99*a*-2. When in the neutral configuration, the extended section 97*a*-1 can be disposed over the lowered portion 99*a*-1 and the lowered section 97*a*-2 can be disposed over the extended portion 99*a*-2. When in the tilted configuration, the extended section 97*a*-1 can be disposed over the extended portion 99*a*-2 and the lowered section 97*a*-2 can be disposed over the lowered portion 99*a*-1. The transition between the neutral and tilted configurations can include the upper cam surface 97*a* slidingly engaging and rotating relative to the lower cam surface 99*a*.

The engagement protrusion 98*d* of the pivotable coupler member 98 can be inserted within an interior 3*d* of the lower portion 3*b* of the umbrella pole 3 and fixedly or removably engaged therewith. The engagement protrusion 98*d* can be mechanically or otherwise fixed to the lower portion 3*b*. The engagement protrusion 98*d* can optionally extend into the lower portion 3*b* a distance to rigidly fix the lower portion 3*b* with the pivotable coupler member 98.

The pivotal coupler member 98 is pivotally coupled with the upper cam member 97 at the contoured extension 98*b*. The contoured extension 98*b* is inserted into the pivot chamber 97*c* of the upper cam member 97. The pin 98*a* can be inserted through the pivot location 97*b* and into the contoured extension 98*b*. Thereby the lower portion 3*b* is pivotally engaged with the upper portion 3*a* of the umbrella pole 3. The contoured extension 98*b* pivots within the pivot chamber 97*c*.

The pivot chamber 97*c* can comprise a contoured wall 97*c*-1 that substantially matches or slidingly engages with a contoured portion 98*b*-1 of the contoured extension member 98*b*. Optionally, the contoured portion 98*b*-1 matches the contoured wall 97*c*-1 in both the neutral and tilted configurations and throughout the transition between the two configuration. This configuration of the tilt assembly 90 has the advantage of allowing for the pivot chamber 97*c* and the contoured extension member 98*b* to be in continual contact as the tilt assembly 90 moves between the tilted position and the neutral position. The more surface area contacted between the contoured extension member 98*b* and the pivot chamber 97*c* results in a smoother and more stable movement during the transition between the neutral and the tilted states and a more rigid connection between the upper portion 3*a* and the lower portion 3*b* of the umbrella pole 3 when in both positions. Optionally, the additional contact surface area between the contoured extension member 98*b* and the pivot chamber 97*c* prevents unwanted movement between the upper portion 3*a* and the lower portion 3*b*. In some embodiments the pin 98*a* and/or the contoured extension member 98*b* comprise a metal or hard plastic material such as steel or any of the rigid and durable polymers.

The pivot chamber 97*c* can also comprise a stop portion 97*c*-2 that abuts a portion 98*b*-2 of the contoured extension member 98*b* when the tilt assembly 90 is in a tilted position as illustrated in FIG. 3*c*. The interaction of the stop portion 97*c*-2 and the contoured extension member 98*b* prevents the tilt assembly 90 from tilting beyond a desired angle between the upper portion 3*a* and the lower portion 3*b* of the umbrella pole 3 Optionally the stop portion 97*c*-2 of the pivot chamber 97*c* is substantially planar as is the contoured portion 98*b*-2 of the contoured extension member 98*b* that abuts it.

The lower cam member 99 can be disposed around the pivotable coupler member 98. The pivotable coupler member 98 is rotationally fixed with respect to the upper cam member 97 and with respect to the upper portion 3*a* of the umbrella pole 3. The lower cam member 99 is rotationally engaged with the pivotable coupler member 98. Lower cam member 99 rotates relative to pivotable coupler member 98 and the upper cam member 97. As lower cam member 99 rotates, the lower cam surface 99*a* slidingly engages the upper cam surface 97*a* as described above. As the lower cam surface 99*a* is rotated (such as by a user) the extended portion 97*a*-1 of the upper cam surface 97*a* is rotated to engage with the extended section 99*a*-2 of the lower cam surface 99*a*. The effect is that the upper cam member 97 must pivot on the pin 98*a* at the pivot location 97*b* of the upper cam member 97. The effect is to create the tilted configuration of the tilt assembly 90.

Optionally when the lower hub body 11 is inserted over the pivotable coupler member 98 and at least a portion of the lower cam member 99, the flanges 93 can engage with protrusions 99*c* of the lower cam member 99. Such that when a user rotates the lower hub body 11 with respect to the pole 3, the flanges within the central aperture 67 engage with the protrusions 99*c* and cause the lower cam member to rotate with the lower hub body 11 and thereby rotate the upper cam surface 97*a* with respect to the upper cam member 97 and tilt the tilt assembly 90.

The lower hub body 11 can be removably engaged with the lower cam member 99. In some embodiments, the lower cam member 99 has the lip 99*e* that can be engaged by the clip assembly 92 of the lower hub body 11. The clip assembly 92 can be releasably engaged with the stop ring 99*b* by moving the lower hub body 11 up onto the upper portion 3*a* of the umbrella pole 3 to overlap with the lower cam member 99, the lower cam member 99 passing at least partially into the central aperture 67 of the lower hub body 11. Optionally the spring 94 and the tail extension 92*a* position the clip assembly 92 in an intermediate position such that as the lower hub body 11 is moved over the lip 99*e* and the lower cam member 99 can be inserted into the central aperture 67. Upon insertion of the lower cam member 99 into the central aperture 67, the lip 99*e* can rotate the clip assembly 92 on the pivot member 95 and the spring 94 can return the clip assembly 92 to an intermediate position such that the lip 99*e* can be caught by the engagement end 92*b* of the clip assembly 92. The tail end 92*a* can prevent the clip assembly 92 from extending into the central aperture 67 such that the clip assembly 92 blocks the lower cam member 99 from being inserted into the central aperture 67 of the lower hub body 11. Optionally the lip 99*e* comprises a lower chamfered surface for easily engaging in actuating the clip assembly 92 as the lower cam member is inserted into the central aperture 67.

Optionally the stop ring 99*b* can prevent the lower cam member from being inserted beyond a set distance into the central aperture 67. The stop ring 99*b* can abut with the lower hub cap 12. In some embodiments the stop ring 99*b* can comprise at least one extension extending from the lower cam member 99.

Optionally the lower cam member can comprise a nub 99*h* extending radially inward into the central portion 99*d* of the lower cam member 99. The nub 99*h* can be slideably engaged with the rotation slot 98*e* of the pivotable coupler member 98. In some embodiments the rotation slot 98*e* extends only partially around the circumference of the pivotable coupler member 98. In other embodiments, the rotation slot 98*e* extends all the way around the pivotable coupler member 98.

In the illustrated embodiment, the nub 99*h* interacts with the first end 99*e*-1 of the lip 99*e* and a second end of the rotation slot 98*e* (not shown). The rotation slot 98*e* thus prevents the lower cam member 99 from being fully rotational in 360 degrees with respect to the pivotable coupler member 98. This causes the lower cam member 99 to rotate between two extreme positions. Optionally, two extreme positions correspond to the tilted configuration and the neutral configuration of the tilt assembly 90. Optionally the rotation slot 98*e* comprises an assembly portion of the slot 98*e*-2. Because the pivotable coupler member 98 can be inserted into the engagement protrusion 98*d* of the lower cam member 99 and the nub 99*h* can be engaged within the rotation slot 98*e*, there must be a way for the lower cam member 99 to be slid over the body and exterior surface 98*c* of the pivotable coupler member 98. The slot 98*e*-2 thus provides a way for the lower cam member 99 to be disposed on the pivotable coupler member 98.

It should be understood that throughout this Application the terms rib and strut can be substituted one for the other. Similarly, the terms upper hub and lower hub can be substituted by upper nest and runner and certain features of the upper hub may be used with the lower hub while certain features of the lower hub can be used with the upper hub. This means that what is disclosed as referring to either of the upper hub or the lower hub or the strut or the rib can equally apply to the other.

What is claimed is:

1. A portable umbrella assembly comprising:

an umbrella pole extending along a longitudinal axis, an upper hub disposed on the umbrella pole and comprising a plurality of first slots;

a plurality of wire ribs configured for supporting a canopy, L-shaped inner ends of the wire ribs including lateral end portions at least partially disposed within respective first slots of the upper hub;

a lower hub disposed about the umbrella pole and comprising a plurality of second slots;

a plurality of wire struts, L-shaped inner ends of the wire struts including lateral end portions that are at least partially disposed within respective second slots of the lower hub, and outer ends of the wire struts pivotably coupled with respective wire ribs of the plurality of wire ribs; and wherein the first slots of the upper hub oppose movement of the L-shaped inner ends of the wire ribs in a first direction such that the L-shaped inner ends of the of wire ribs are maintained within the first slots and the second slots of the lower hub oppose movement of the L-shaped inner ends of the wire struts in a second direction, opposite the first direction, such that the L-shaped inner ends of the of the wire struts are maintained within the second slots of the lower hub.

2. The portable umbrella assembly of claim 1, wherein the wire ribs and the wire struts are steel rods.

3. The portable umbrella assembly of claim 1, wherein the L-shaped inner ends of the wire ribs include elongate straight portions and elongate lateral portions, the elongate straight portions being perpendicular to the elongate lateral portions.

4. The portable umbrella assembly of claim 3, wherein the first slots include a radial portion for receiving respective elongate straight portions and circumferential portions for receiving respective elongate lateral portions.

5. The portable umbrella assembly of claim 4, wherein the circumferential portions of the first slots are at least partially blocked by a respective retaining protrusion configured to provide a resistance force against the elongate lateral portions when a radial force is exerted on the wire ribs in the first direction.

6. The portable umbrella assembly of claim 4, wherein the radial portions are bounded by a respective uninterrupted radial wall.

7. The portable umbrella assembly of claim 1, wherein the first direction is counterclockwise and the second direction is clockwise.

8. The portable umbrella assembly of claim 1, the upper hub further comprising:

an upper hub body including the first slots arranged circumferentially around an outer perimeter of the upper hub body; and an upper hub cap including a plurality of projections, the projections insertable through the upper hub body to partially block respective first slots and trap respective L-shaped inner ends of the wire ribs therein.

9. The portable umbrella assembly of claim 1, the lower hub further comprising:

a lower hub body including the second slots arranged circumferentially around an outer perimeter of the lower hub body; and a lower hub cap including a plurality of projections, the projections insertable through the lower hub body to partially block respective second slots and trap respective L-shaped inner ends of the wire struts therein.

10. A portable umbrella comprising:

an upper hub configured to be disposed on an umbrella pole and comprising a plurality of first slots;

a plurality of wire ribs configured for supporting a canopy, L-shaped inner ends of the wire ribs including lateral end portions configured to be at least partially received within respective first slots of the upper hub;

a lower hub configured to be disposed about the umbrella pole and comprising a plurality of second slots;

a plurality of wire struts with L-shaped inner ends including lateral end portions configured to be at least partially received within respective second slots of the lower hub and outer ends configured for pivotally coupling with respective wire ribs; and wherein in an assembled configuration, the L-shaped inner ends of the wire ribs are received within the first slots of the upper hub and inner walls of the first slots oppose movement of the L-shaped inner ends of the wire ribs in a first direction such that the L-shaped inner ends of the of wire ribs are maintained within the first slots and the L-shaped inner ends of the wire struts are received within the second slots of the lower hub and inner walls of the second slots oppose movement of the L-shaped inner ends of the wire struts in a second direction, opposite the first direction, such that the L-shaped inner ends of the of the wire struts are maintained within the second slots of the lower hub.

11. A portable umbrella assembly comprising:

an wire member including an L-shaped inner end including an elongate straight portion and an elongate lateral portion; and a hub, the hub comprising:

a hub body including a plurality of slots disposed around a periphery, a slot of the plurality of slots including a radial section extending along an radial wall and a circumferential section extending circumferentially from the radial portion in a first direction;

a hub cap including a plurality of projections corresponding to the plurality of slots extending from a base;

an upper surface of the hub body including a plurality of passages corresponding to the plurality of slots and the plurality of projections, a passage of the plurality of passages aligned with the circumferential section of the slot, a projection of the plurality of projections configured to be insertable through the passage to at least partially block the circumferential section of the slot and thereby trap the elongate lateral portion of the L-shaped inner end therein; and wherein the radial wall of the upper hub opposes movement of the elongate straight portion of the L-shaped inner end in a second direction, opposite the first direction, and the projection opposes movement of the elongate lateral portion of the L-shaped inner end, such that the L-shaped inner end of the wire member is maintained within the slot of the hub.

12. The portable umbrella assembly of claim 11, wherein the radial wall is uninterrupted.

13. The portable umbrella assembly of claim 11, wherein the elongate straight portion is perpendicular to the elongate lateral portion.

14. The portable umbrella assembly of claim 11, wherein the hub body comprises an central passage and is configured to be disposed about an umbrella pole.

15. The portable umbrella assembly of claim 14, wherein the base of the hub cap comprises an annular member configured to be disposed about the umbrella pole.

16. The portable umbrella assembly of claim 11, wherein either the hub cap or the hub body comprises a cantilevered hook and the other of the hub cap and the hub body includes an engagement lip, the cantilevered hook configured to engage the engagement lip when the projection is within the circumferential section of the slot.

17. The portable umbrella assembly of claim 11, wherein the hub is an upper hub.

18. The portable umbrella assembly of claim 11, wherein the hub is a lower hub.

19. The portable umbrella assembly of claim 11, wherein the elongate straight section of the wire member is pivotable relative to the hub about the elongate lateral section disposed within the slot.

* * * * *